US008494192B2

(12) United States Patent
Yokota et al.

(10) Patent No.: US 8,494,192 B2
(45) Date of Patent: Jul. 23, 2013

(54) AUDIO REPRODUCING SYSTEM AND METHOD THEREOF

(75) Inventors: Teppei Yokota, Chiba (JP); Nobuyuki Kihara, Tokyo (JP)

(73) Assignee: Sony Corporation, Tokyo (JP)

( * ) Notice: Subject to any disclaimer, the term of this patent is extended or adjusted under 35 U.S.C. 154(b) by 1499 days.

(21) Appl. No.: 11/699,810

(22) Filed: Jan. 30, 2007

(65) Prior Publication Data

US 2007/0183617 A1 Aug. 9, 2007

(30) Foreign Application Priority Data

Feb. 1, 2006 (JP) ..... 2006-024302

(51) Int. Cl.
*H04R 5/02* (2006.01)

(52) U.S. Cl.
USPC ..... 381/310; 381/1; 381/17; 381/18; 381/87; 381/300; 381/301; 381/333; 381/335; 381/386; 381/388

(58) Field of Classification Search
USPC ..... 381/386, 388, 301, 335, 1, 17, 18, 381/87, 300, 310, 333
See application file for complete search history.

(56) References Cited

U.S. PATENT DOCUMENTS

| | | | | |
|---|---|---|---|---|
| 3,115,947 | A | 12/1963 | Wood | |
| 3,824,343 | A * | 7/1974 | Dahlquist | 381/335 |
| 3,870,834 | A * | 3/1975 | Yeaple | 381/301 |
| 5,282,251 | A | 1/1994 | Petersen | |
| 5,887,071 | A | 3/1999 | House | |
| 7,336,792 | B2 | 2/2008 | Sasaki | |
| 2003/0099369 | A1 * | 5/2003 | Cheng | 381/309 |
| 2003/0103636 | A1 | 6/2003 | Arai et al. | |
| 2007/0195964 | A1 | 8/2007 | Yokota | |
| 2008/0187156 | A1 | 8/2008 | Yokota | |
| 2008/0292121 | A1 | 11/2008 | Yokota | |

FOREIGN PATENT DOCUMENTS

| | | | |
|---|---|---|---|
| CN | 1419796 | A | 5/2003 |
| EP | 1137319 | A3 | 7/2003 |
| EP | 1439509 | | 7/2004 |
| FR | 2859863 | | 3/2005 |
| GB | 2426169 | A | 5/2005 |
| JP | 61-095189 | U | 6/1986 |
| JP | 03-069466 | U | 7/1991 |
| JP | 03-235498 | A | 10/1991 |
| JP | 5-95591 | | 4/1993 |
| JP | 05-191342 | A | 7/1993 |
| JP | 08-047080 | A | 2/1996 |
| JP | 9-284883 | | 10/1997 |
| JP | 09-298797 | A | 11/1997 |

(Continued)

*Primary Examiner* — Vivian Chin
*Assistant Examiner* — Paul Kim
(74) *Attorney, Agent, or Firm* — Wolf, Greenfield & Sacks, P.C.

(57) ABSTRACT

An audio reproducing system includes a pair of speaker units, a mounting unit for mounting the pair of speaker units, without being attached to a baffle board, to the vicinity of a listener's ears in a manner such that sounds emitted from the front and back of a diaphragm of each speaker unit are mixed, and an audio signal output unit for virtual sound imaging an input audio signal and outputting the virtual sound imaged signal to the pair of speaker units in a manner such that the listener listens to a sound reproduced by the pair of speaker units feeling as if the sound is emitted from a different speaker device.

13 Claims, 26 Drawing Sheets

FOREIGN PATENT DOCUMENTS

| | | | |
|---|---|---|---|
| JP | 09-327099 | | 12/1997 |
| JP | 10-014000 | A | 1/1998 |
| JP | 10-224900 | | 8/1998 |
| JP | 10-243500 | A | 9/1998 |
| JP | 2000-515700 | T | 11/2000 |
| JP | 2001-078288 | A | 3/2001 |
| JP | 2001-268700 | A | 9/2001 |
| JP | 2002-269916 | A | 9/2002 |
| JP | 2002-291100 | A | 10/2002 |
| JP | 2003-061197 | A | 2/2003 |
| JP | 2004-135023 | A | 4/2004 |
| JP | 2004-187300 | A | 7/2004 |
| JP | 2004-289762 | A | 10/2004 |
| JP | 2004-357075 | A | 12/2004 |
| JP | 2005-45533 | | 2/2005 |
| JP | 2005-280580 | A | 10/2005 |
| JP | 2006-245477 | A | 9/2006 |
| JP | 2006-345477 | A | 12/2006 |
| JP | 2006-345480 | A | 12/2006 |
| JP | 2007-001507 | A | 1/2007 |
| JP | 2007-195092 | A | 8/2007 |
| WO | WO 2006/109389 | A1 | 10/2006 |

* cited by examiner

AUDIO REPRODUCING SYSTEM AND METHOD THEREOF

CROSS REFERENCES TO RELATED APPLICATIONS

The present invention contains subject matter related to Japanese Patent Application JP 2006-024302 filed in the Japanese Patent Office on Feb. 1, 2006 the entire contents of which is incorporated herein by reference.

BACKGROUND OF THE INVENTION

1. Field of the Invention

The present invention relates to a method and system for reproducing multi-channel surround audio signal such as 5.1 channel surround audio signal.

2. Description of the Related Art

Audio-visual reproducing systems called home theaters are being widely used. The audio-visual reproducing system reproduces video from a digital versatile disk (DVD) on a relatively large-screen display while using a multi-channel surround audio system such as 5.1 channel surround audio system for sound reproduction. The audio-visual reproducing system thus reproduces powerful audio-visual content.

The 5.1 channel audio-visual reproducing system uses four types of speakers, a speaker in front of a listener (hereinafter referred to as front speaker), a speaker in center front of a listener (hereinafter referred to as a center speaker), a speaker in rear of the listener (hereinafter referred to as rear speaker), and a speaker dedicated to low-frequency sound. A subwoofer as a low-frequency speaker is responsible for monophonic sound in a band of 100 Hz or lower. The other speakers work in a range from 100 Hz to 20 kHz.

A typical known 5.1 channel audio-visual reproducing system is shown in FIG. 31. As shown in FIG. 31, a front left channel speaker 10FL is placed in front left of a listener 4, a front right channel speaker 10FR is placed in front right of the listener 4, and a center channel speaker 10C is placed in center front of the listener 4.

Furthermore, a rear left channel speaker 10RL is placed in rear left of the listener 4, and a rear right channel speaker 10RR is placed in rear right of the listener 4. A subwoofer 10SW as a low-frequency effect (LFE) channel speaker is arranged at any convenient location.

The six speakers 10FL, 10FR, 10C, 10RL, 10RR, and 10SW are housed in the boxes thereof, and placed at the locations thereof. The six speakers are typically spaced from the listener 4 by a distance ds of about 2 meters.

In the known audio-visual reproducing system, a speaker box having a volume of 15 liters was used for the front left and right channel speakers. Currently, each of the front left and right channel speakers, housed in a small box having a volume of about 1 liter, is also referred to a satellite speaker. Since these speakers are naturally unable to provide low-frequency sound, and to compensate for this, a speaker dedicated to low-frequency sound, called a subwoofer, is added. If the speakers other than the subwoofer are housed in the small boxes, a cross-over frequency of the audio signal supplied to the subwoofer 10SW is typically 150 Hz, slightly higher than typical 100 Hz, but still a sufficiently low frequency.

In the speaker system thus configured, a sufficient low-frequency sound is generated when a 5.1 channel audio signal is reproduced from a DVD. Furthermore, since a reproducing side also includes a special channel particular for a low-frequency sound, the low-frequency sound is fully provided within the room in a manner that has never been performed before. The user thus can enjoy the powerful presence of sound and video.

However, a small room made of weak wall and floor material may not have a sufficient space to accommodate the six speakers, and may result in a noise problem due to sound leakage to the outside of the room.

When a user wishes to enjoy a powerful audio sound in audio-visual content from a DVD with an ordinary 5.1 channel speaker system, a sound level of 90 dB or higher is required. Noise problem to the ambient environment needs to be addressed when the user attempts to enjoy the effect of the multi-channel sound.

Even a single door or wall can easily isolate sound if the sound is high frequency. However, a low-frequency sound as low as 100 Hz or so cannot be easily isolated. A small room is not sufficient to isolate the low-frequency sound. In particular, a sound of 40 Hz to 50 Hz, handled by the subwoofer, resounds well, and propagates throughout a relatively wide area.

The sound reproduced by the subwoofer may leak out not only to a next room but also to rooms upstairs or downstairs, thereby possibly annoying persons in the next room. The lower the frequency of the sound, the more difficult the isolation of the sound is. The subwoofer is a problem and the otherwise excellent 5.1 audio reproducing system cannot be fully enjoyed.

Japanese Unexamined Patent Application Publication No. 5-95591 discloses an audio reproducing system in which an intermediate to high frequency sound is reproduced by a small speaker (housed in a speaker box) and a low-frequency sound is reproduced in the vicinity of the ears of the listener with a low-frequency headphone or using a bone conduction mechanism.

In accordance with the disclosure, the low-frequency sound is reproduced using the headphone or the bone conduction mechanism. The low-frequency sound, heard at a high level by the listener, does not propagate to next rooms or a next house.

SUMMARY OF THE INVENTION

The technique disclosed in Japanese Unexamined Patent Application Publication No. 5-95591 employs vibrators to reproduce the sound in the vicinity of the ears of the listener, such as a headphone or a bone conduction mechanism, instead of a speaker. Such vibrators do not so work well as the speaker in terms of low-frequency performance and are not expected to be widely accepted by users, although how well such vibrators are accepted vary to users' preference. Further, wearing the headphone or the bone conduction headphone is troublesome to listeners.

The disclosed technique alleviates the noise problem of the low-frequency sound, but does not meet the need that many speakers be installed within a limited space.

It is thus desirable to provide an audio reproducing method and an audio reproducing system for reproducing a multi-channel surround signal with speakers of the number smaller than the number of channels with the level of sound traveling to neighboring house controlled even if the signal is reproduced at a high volume level.

An audio reproducing system of one embodiment of the present invention includes a pair of speaker units, a mounting unit for mounting the pair of speaker units, without being attached to a baffle board, to the vicinity of a listener's ears in a manner such that sounds emitted from the front and back of a diaphragm of each speaker unit are mixed, and an audio signal output unit for virtual sound imaging an input audio signal and outputting the virtual sound imaged signal to the pair of speaker units in a manner such that the listener listens to a sound reproduced by the pair of speaker units feeling as if the sound is emitted from a different speaker device.

The listener can hear the sound at a high volume level because the speaker unit is held close to the ears of the listener.

Since the speaker unit is not installed on a baffle board, the reproduced sound is emitted from the front and rear of the diaphragm of the speaker unit. The sound emitted from the front of the diaphragm and the sound emitted from the back of the diaphragm are opposite to each other in phase. As the sounds travel externally, the sounds cancel each other, and attenuate the intensity thereof. The lower the frequency of the sound, the more the attenuation of the sound becomes. The sound, in particular, low-frequency sound, traveling to neighboring houses is substantially attenuated.

In accordance with embodiments of the present invention, the speaker unit virtual sound images (sound image localizing) a front channel sound or a rear channel sound of a multi-channel surround sound, and then reproduces the processed signal as a front-channel sound or a rear-channel sound. The embodiments of the present invention eliminate the need for a front-channel speaker and a rear-channel speaker.

In accordance with embodiments of the present invention, the speaker unit mounted closely to the ears of the listener. If a sound is reproduced at a high volume level, the traveling of a low-frequency sound to neighboring houses is controlled. Since the audio signal supplied to the speaker unit is virtual sound imaged, the front-channel sound and the rear-channel sound of the multi-channel surround sound are virtually reproduced by the speaker unit. The multi-channel surround sound is thus reproduced with a smaller number of speakers.

DESCRIPTION OF THE PREFERRED EMBODIMENTS

An audio reproducing system for reproducing a 5.1 channel surround sound in accordance with embodiments of the present invention is described below with reference to the drawings.

First Embodiment

An audio reproducing system of a first embodiment of the present invention is described below. The audio reproducing system reproduces a video and a 5.1 channel surround sound based on a video signal and an audio signal reproduced by a DVD player or based on a digital broadcast signal received by a television receiver.

Figure 1:
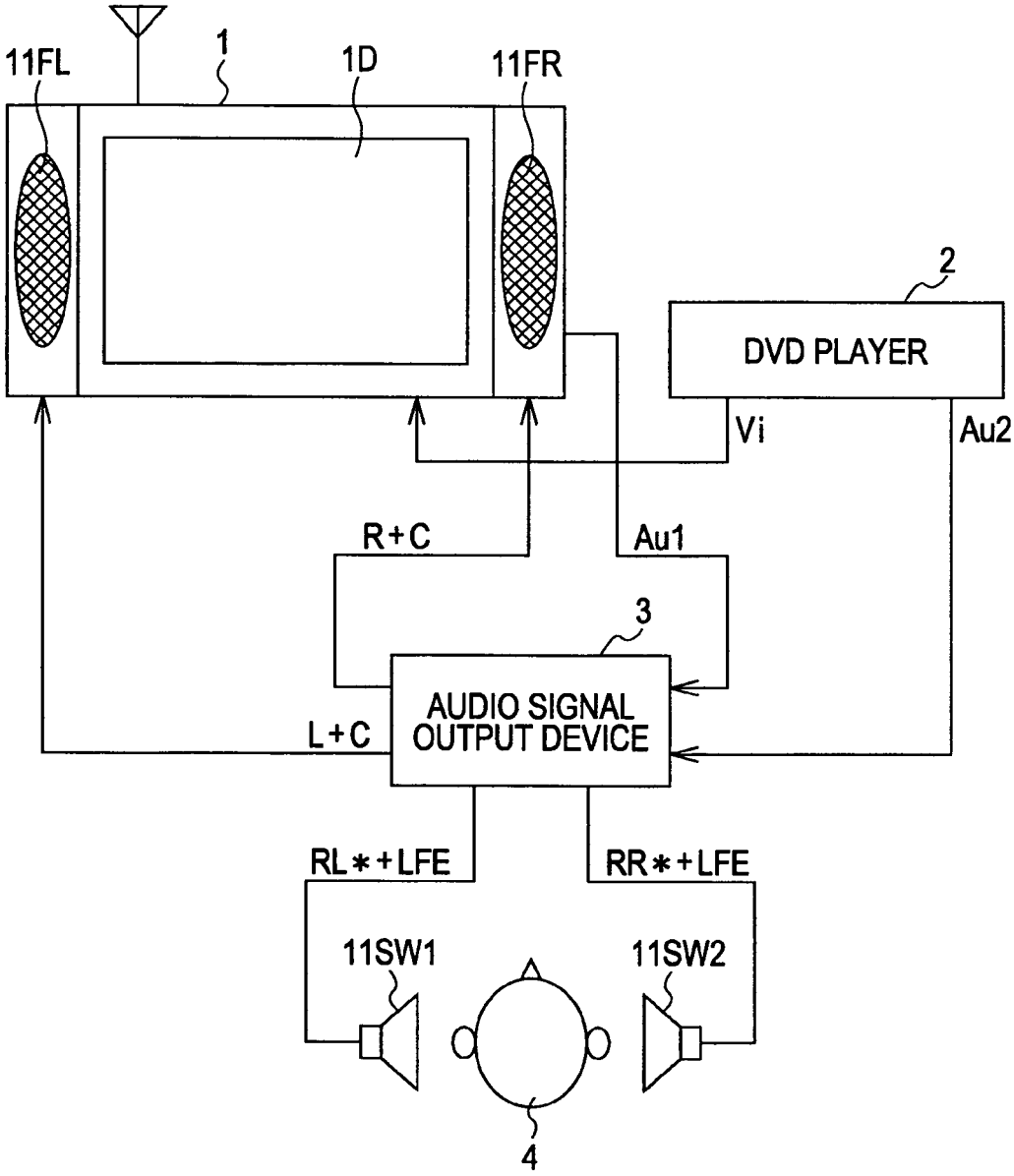
FIG. 1 is a block diagram of an audio reproducing system in accordance with a first embodiment of the present invention.

FIG. 1 illustrates the audio reproducing system of the first embodiment.

As shown in FIG. 1, the audio reproducing system of the first embodiment includes a television receiver 1 including two speakers 11FL and 11FR, a DVD player 2, an audio signal output device 3, and two speakers 11SW1 and 11SW2 mounted close to the ears of a listener 4.

In accordance with the first embodiment of the present invention, the two speakers 11FL and 11FR of the television receiver 1 are used as the front left and right channel audio signals of a 5.1 channel surround sound. The two speakers 11FL and 11FR may be installed in the television receiver 1 or may be arranged separate from the television receiver 1.

In accordance with the first embodiment of the present invention, the two speakers 11SW1 and 11SW2 arranged close to the ears of the listener 4 serve as subwoofers for low-frequency sound of the 5.1 channel surround sound. In accordance with the first embodiment, the audio signal output device 3 virtual sound images rear left and right channel audio signals of the 5.1 channel surround sound and supplies the virtual sound imaged signals to the two speakers 11SW1 and 11SW2 serving as the subwoofers.

The television receiver 1 has a function to receive a digital broadcast signal. The television receiver 1 reproduces an audio signal of a digital broadcast program from a digital broadcast signal, and displays a reproduced video of the digital broadcast program onto a display screen 1D of the television receiver 1 while outputting a reproduced sound of the digital broadcast program from the speakers 11FL and 11FR.

If the audio of the digital broadcast program is a multi-channel surround sound, the reproduced sounds of the digital broadcast program emitted from the speakers 11FL and 11FR contain in addition to the front left and right channel sounds, a center channel sound, and rear left and right channel sounds.

In accordance with the first embodiment, an audio signal Au1, received and then reproduced by the television receiver 1, is supplied to the audio signal output device 3.

The DVD player 2 reproduces and outputs a video signal and an audio signal recorded on a DVD. A video signal Vi reproduced by the DVD player 2 is supplied to the television receiver 1. A reproduced video responsive to the video signal Vi is then displayed on the display screen 1D of the television receiver 1. An audio signal Au2 reproduced by the DVD player 2 is supplied to the audio signal output device 3.

In accordance with the first embodiment, the audio signal output device 3 has a function to decode data of the 5.1 channel surround sound. When the signal of the digital broadcast program received by the television receiver 1 is reproduced into a 5.1 channel surround sound, the audio signal output device 3 produces audio signals to be supplied to a first speaker 11SW1 and a second speaker 11SW2 mounted in the vicinity of the ears of a listener 4, respectively.

When the a video and audio reproduced by the DVD player 2 are used, the audio signal output device 3 supplies not only the audio signals to the first speaker 11SW1 and the second speaker 11SW2 mounted in the vicinity of the ears of the listener 4 but also generates audio signals for the left and right channel speakers 11FL and 11FR in the television receiver 1, and then supplies the audio signal to the respective speakers.

In accordance with the first embodiment, the audio signal output device 3 supplies a front left channel audio signal L and a center channel audio signal C to the speaker 11FL in the television receiver 1 and a front right channel audio signal R and the center channel audio signal C to the speaker 11FR in the television receiver 1.

The audio signal output device 3 supplies a rear left channel audio signal RL* virtual sound imaged as will be discussed later and a low-frequency audio signal LFE to the speaker 11SW1 and a rear right channel audio signal RR* virtual sound imaged as will be discussed later and the low-frequency audio signal LFE to the speaker 11SW2.

A speaker placement configuration in the audio reproducing system of the first embodiment of the present invention is discussed with reference to FIG. 2.

Figure 2:
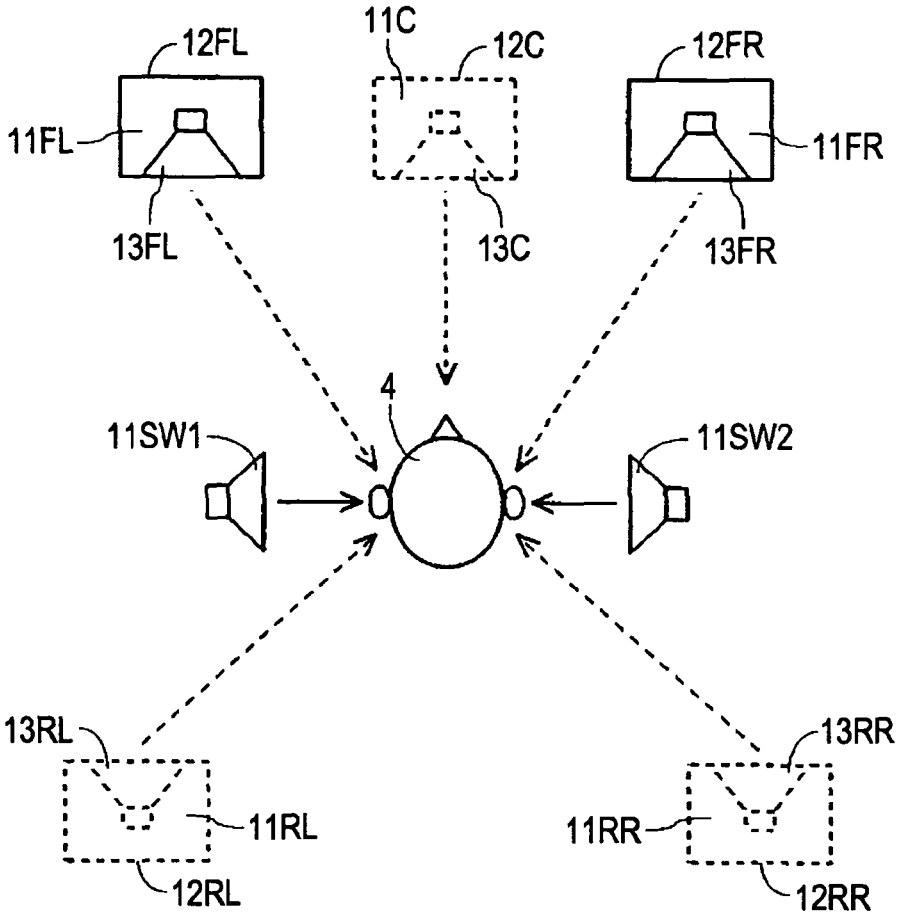
FIG. 2 illustrates a speaker placement configuration of the audio reproducing system in accordance with the first embodiment of the present invention.

As shown in FIG. 2, the front left channel speaker 11FL is arranged in front left of the listener 4, and the front right channel speaker 11FR is arranged in front right of the listener 4.

The television receiver 1 houses the speakers 11FL and 11FR. The speaker 11FL include a speaker unit 13FL and a small speaker box 12FL housing the speaker unit 13FL. The front panel of the speaker box 12FL (such as the front panel of the television receiver 1) serves as a baffle board supporting the speaker unit 13FL. The speaker 11FR include a speaker unit 13FR and a small speaker box 12FR housing the speaker unit 13FR. The front panel of the speaker box 12FR (such as the front panel of the television receiver 1) serves as a baffle board supporting the speaker unit 13FR. If there is no need to discriminate between the speakers 11FL and 11FR, each of the speakers 11FL and 11FR is hereinafter referred to as a front speaker.

In accordance with the first embodiment, the speaker 11SW1 and the speaker 11SW2 are arranged in the vicinity of the ears of the listener 4 with the head of the listener 4 interposed therebetween in a manner such that a diaphragm of each speaker faces a respective ear of the listener 4. The subwoofers 11SW1 and 11SW2 remain out of direct contact with the head and the ears of the listener 4. The two speakers 11SW1 and 11SW2 are not housed in speaker boxes so that the sounds emitted from the front and back of the diaphragm of each speaker unit are mixed. No baffle board is mounted on each of the speakers 11SW1 and 11SW2. More specifically, each of the speakers 11SW1 and 11SW2 is mounted with the diaphragm thereof exposed outwardly. Optionally, as long as acoustics is free from any effect, a mesh or a hole-opened board may cover the speaker or a hole-opened baffle board may be attached to the speaker.

In accordance with the first embodiment, the two speakers 11SW1 and 11SW2 are commonly supplied with the low-frequency audio signal LFE, and thus emits LFE channel low-frequency sounds in phase with each other. The two speakers 11SW1 and 11SW2 thus serve as subwoofers. The two speakers 11SW1 and 11SW2 are hereinafter also referred to as the subwoofers.

Since the LFE channel low-frequency sounds are emitted in the vicinity of the ears of the listener 4 in the above arrangement, the listener 4 can hear the sounds at a high volume level. At a distance from the listener 4, the sounds emitted from the front and back of the diaphragm of each of the speaker units of the subwoofers 11SW1 and 11SW2 become different in phase by about 180 degrees, thereby mutually canceling each other to a level that other persons almost cannot hear. Unlike in the known art, the audio reproducing apparatus of the first embodiment of the present invention prevents the low-frequency sound from reaching the neighboring houses, thereby avoiding annoying neighbors.

Figure 3:
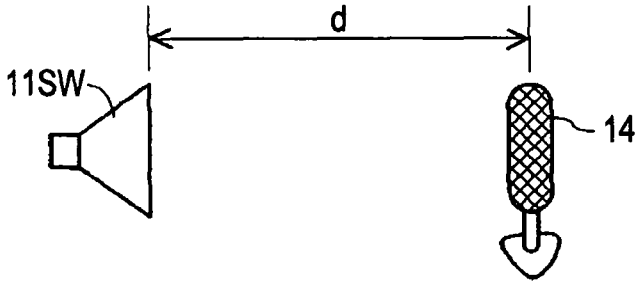
FIG. 3 illustrates a speaker placement in accordance with the first embodiment of the present invention.
Figure 4:
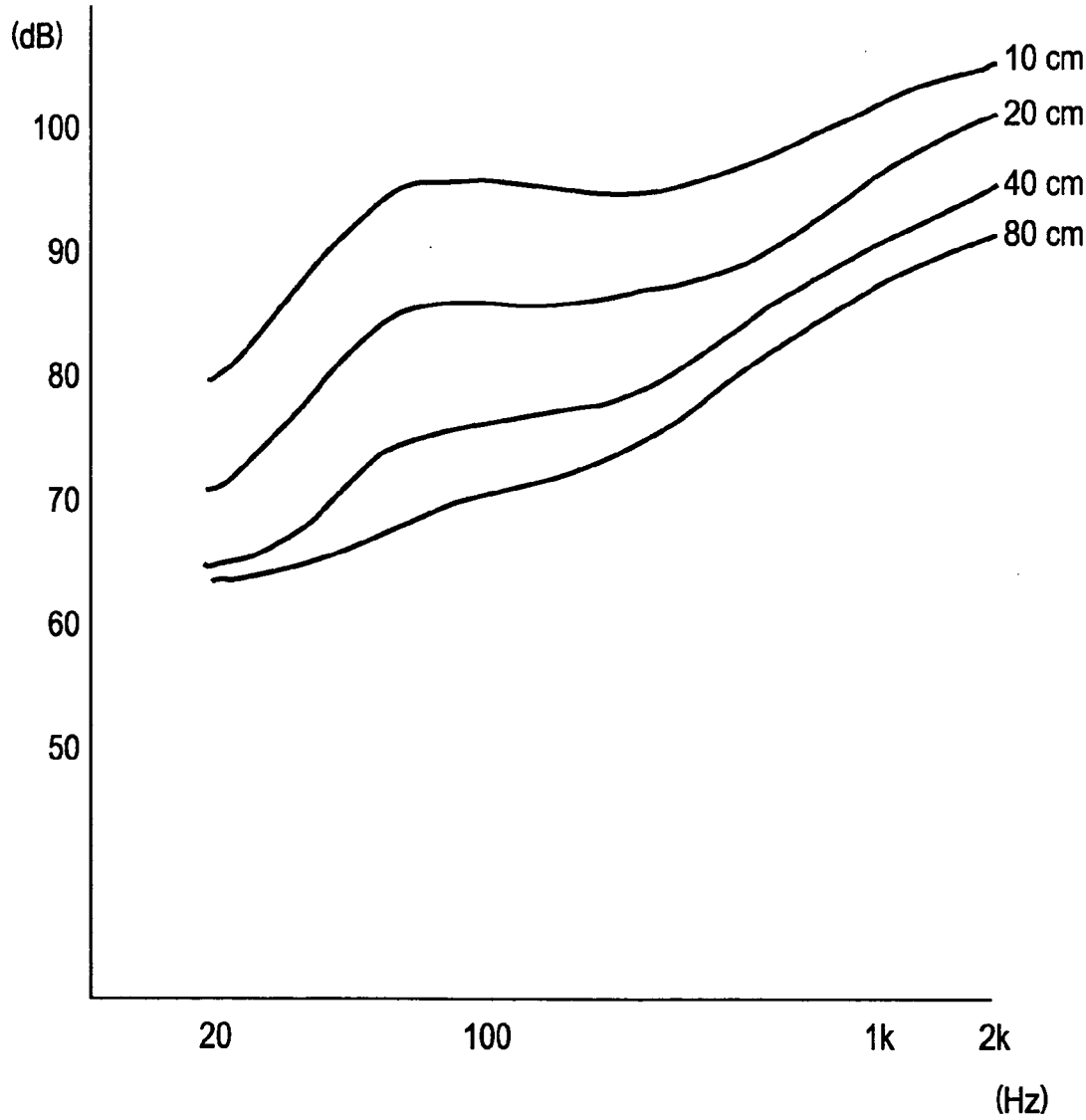
FIG. 4 is a plot explaining operation of the audio reproducing system in accordance with the first embodiment of the present invention.

To verify the attenuation of the low-frequency sound, the sound from the subwoofer such as the speaker unit 11SW having a size of 17 centimeters was picked up at a distance d from the speaker unit 11SW by a microphone 14 as shown in FIG. 3, and the picked sound was then analyzed in terms of frequency characteristics of sound pressure level. FIG. 4 is a plot of the frequency characteristics of the speaker unit 11SW. In this case, the speaker unit 11SW was not housed in a box and no baffle board was attached to the speaker unit 11SW.

Four frequency characteristics curves of FIG. 4 are those measured with a distance d between the speaker unit 11SW and the microphone 14 being set at 10 centimeters, 20 centimeters, 40 centimeters, and 80 centimeters.

As shown in FIG. 4, the sound below 1 kHz is substantially attenuated if the speaker unit 11SW is not housed, and the lower the frequency of the sound, the more pronounced the attenuation of the sound becomes.

In accordance with the first embodiment, the respective distances dsw between the subwoofers 11SW1 and 11SW2 and the left ear and the right ear of the listener 4 are set to a range within which the low-frequency sound travels with no much attenuation involved. The distance dsw is set to be about 20 cm herein.

The distance between the first speaker 11SW and each of the ears of the listener 4 has been typically 2 meters. In accordance with the first embodiment, the distance dsw of 20 centimeters between each of the subwoofers 11SW1 and 11SW2 and each of the ears of the microphone 14 is one-tenth the distance in the known art.

Energy required for the listener 4 to feel a sound pressure is thus one-hundredth the energy required in the known art. For example, a sound pressure provided by a 100 w amplifier is achieved by a 1 w amplifier if the apparatus of the first embodiment of the present invention is employed.

In accordance with the first embodiment, the difference in the power of the audio signal output supplied to the speaker causes sound to spread less. At the low-frequency sounds, such as of 20 Hz, 30 Hz, and 40 Hz, the low-frequency sounds cancel each other in phase, and almost no sound is heard by persons except a person who is very close to the subwoofers 11SW1 and 11SW2. On the other hand, the effectiveness of isolation of powerful sound effects of a DVD software program is more pronounced because much energy is concentrated in the low-frequency region of sound.

With the above-discussed arrangement, a sufficient result is achieved if it is important to attenuate the low-frequency sound only. Similarly, a sound insulation effect is achieved even if sounds other than the low-frequency sound are reproduced from the subwoofers 11SW1 and 11SW2.

The 5.1 channel surround sounds further include a center channel sound and rear left and right channel sounds. In the known art, a center channel speaker 11C includes a speaker box 12*c* and a speaker unit 13C housed in the speaker box 12*c*. The speaker unit 13C is secured to a front panel of the speaker box 12*c* serving as a baffle board as represented by broken line in FIG. 2. The center channel speaker 11C is arranged in front of the listener 4.

Similarly, in the known art, a rear left channel speaker 11RL includes a rear speaker unit 13RL and a small speaker box 12RL housing the rear speaker unit 13RL. The rear speaker unit 13RL is secured to a front panel of the speaker box 12RL serving as a baffle board as represented by broken line in FIG. 2. A rear right channel speaker 11RR includes a rear speaker unit 13RR and a small speaker box 12RR housing the rear speaker unit 13RR. The rear speaker unit 13RR is secured to a front panel of the speaker box 12RR serving as a baffle board as represented by broken line in FIG. 2.

In accordance with the first embodiment, however, the speakers 11C, 11RL, and 11RR respectively dedicated to the center channel sound and the rear left and right channel sounds are not arranged. As previously discussed, the sounds are reproduced using the two speakers 11FL and 11FR in the television receiver 1 and the two speakers 11SW1 and 11SW2 arranged in the vicinity of the ears of the listener 4.

More specifically, the center channel audio signal C is added to each of the front left channel audio signal L and the front right channel audio signal R, and then the resulting signals are respectively supplied to the speakers 11FL and 11FR for sound reproducing.

The rear left channel audio signal RL is virtual sound imaged into the rear left channel audio signal RL*, and the rear left channel audio signal RL* is then supplied to the speaker 11SW1 facing the left ear of the listener 4. The rear right channel audio signal RR is virtual sound imaged into the rear right channel audio signal RR*, and the rear right channel audio signal RR* is supplied to the speaker 11SW2 facing the right ear of the listener 4.

Since the distance between each of the speakers 11SW1 and 11SW2 and each of the ears of the listener 4 is small, radiated energy of the rear left and right channel audio signals RL and RR is lowered to contribute to sound isolation.

The sound reproduction of the rear left and right channel audio signals is performed by the subwoofers 11SW1 and 11SW2 arranged close to the ears of the listener 4. The localization of the rear left and right channel audio signals is not so important because the rear left and right channel sounds are mainly originated from sound reverberation from behind the listener 4. An excellent surround sound is produced with a smaller number of speakers and low noise level involved.

As previously discussed, the sound pressure of the subwoofers 11SW1 and 11SW2 can be reduced by about 20 dB because the distance dsw between the ears of the listener 4 and the corresponding subwoofers 11SW1 and 11SW2 is shortened from about typical 2 meters to about 20 centimeters. The same is also true of the rear left and right channel audio signals RL and RR, and energy saving is thus achieved.

As a speaker mounting example, the speakers may be mounted on a massage chair.

Figure 5:
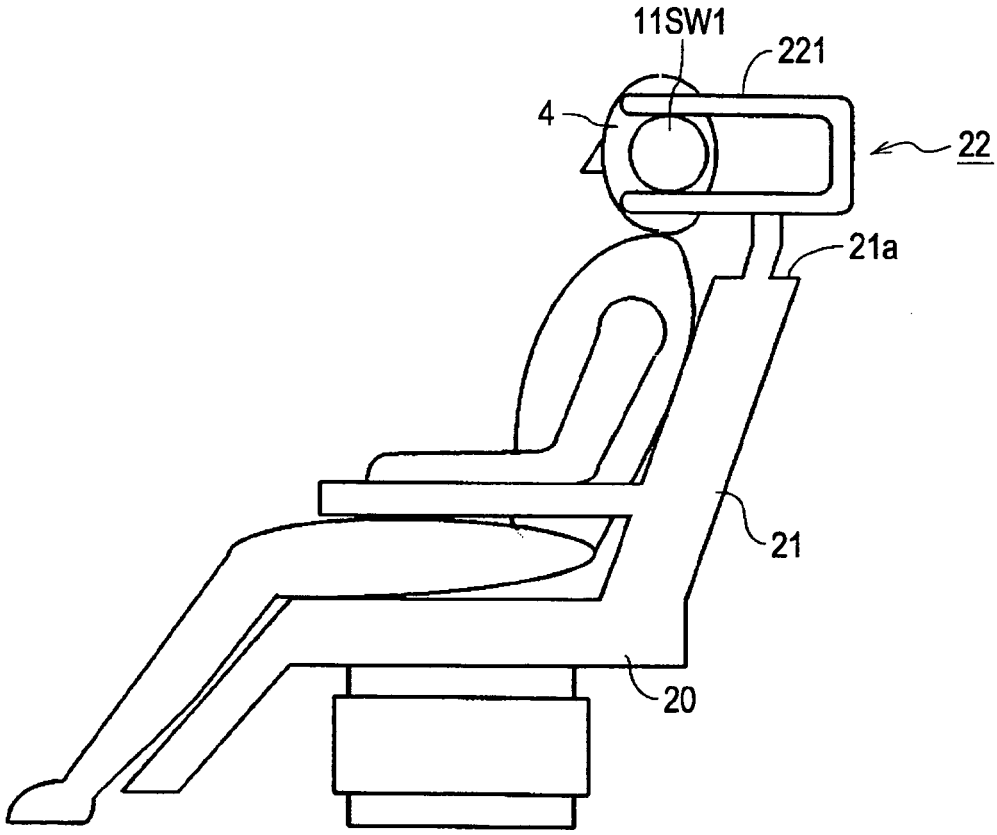
FIG. 5 illustrates a speaker placed in accordance with the first embodiment of the present invention.

FIG. 5 illustrates such an example. The two speakers 11SW1 and 11SW2, expected to be mounted close to the ears of the listener 4, are installed on a chair 20.

The chair 20 has a structure of a business-class seat in an airplane, for example. A speaker holder 22 is mounted on a top 21*a* of a backrest 21 of the chair 20. The speaker holder 22 supports the subwoofers 11SW1 and 11SW2.

Figure 6A:
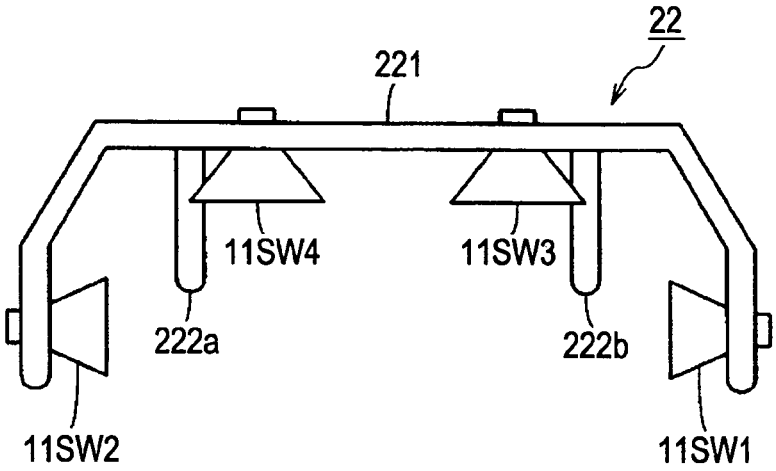
FIGS. 6A and 6B illustrates a speaker mounted in accordance with the first embodiment of the present invention.
Figure 6B:
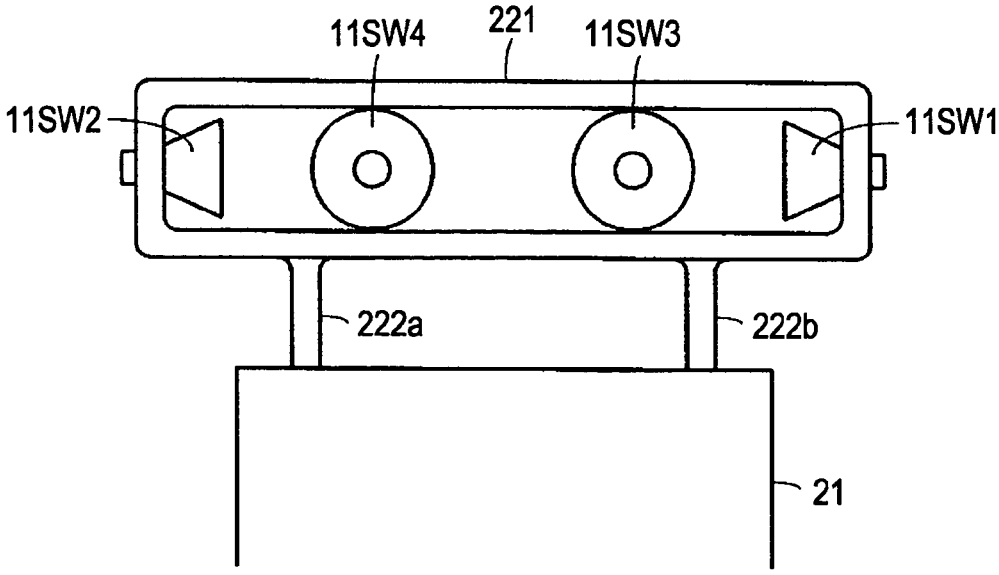

FIGS. 6A and 6B illustrate an example of the speaker holder 22. The speaker holder 22 is constructed of a metal pipe 221 made of aluminum, for example. As shown in FIG. 6B, the metal pipe 221 has a flattened ring configuration. The subwoofers 11SW1 and 11SW2 and further auxiliary subwoofers 11SW3 and 11SW4 are held within space defined by the metal pipe 221.

The auxiliary subwoofers 11SW3 and 11SW4 supports the subwoofers 11SW1 and 11SW2 arranged close to the ears of the listener 4 if the subwoofers 11SW1 and 11SW2 alone lacks power of the low-frequency sound. The auxiliary subwoofers 11SW3 and 11SW4 are not essential elements.

In accordance with the first embodiment, the low-frequency signal (LFE signal) only is supplied to the auxiliary subwoofers 11SW3 and 11SW4. Like the subwoofers 11SW1 and 11SW2, the auxiliary subwoofers 11SW3 and 11SW4 also may also receive the audio signals that have been virtual sound imaged.

The metal pipe 221 has a flattened ring configuration. The flattened ring portion of the metal pipe 221 has a generally U-shape in plan view as shown in FIG. 6A so that the metal pipe 221 surround the sides (the ears) and the back of the head of the listener 4 except for the front of the head of the listener 4.

Foot portions 222*a* and 222*b* are extended from the metal pipe 221 to support the metal pipe 221 to the backrest 21 of the chair 20. The foot portions 222*a* and 222*b* detachably connects the metal pipe 221 to the backrest 21 on the chair 20. The top 21*a* of the backrest 21 of the chair 20 has deep sockets (not shown) to receive the foot portions 222*a* and 222*b*. With the foot portions 222*a* and 222*b* received in the deep sockets in the backrest 21, the metal pipe 221 is secured to the backrest 21.

The subwoofers 11SW1 and 11SW2 are supported by the U-shaped metal pipe 221 in a manner such that the subwoofers 11SW1 and 11SW2 face the left and right ears of the listener 4 when the listener 4 sits on the chair 20. The auxiliary subwoofers 11SW3 and 11SW4 are supported by the metal pipe 221 in a manner such that the auxiliary subwoofers 11SW3 and 11SW4 face the back of the head of the listener 4 when the listener 4 sits on the chair 20.

When the listener 4 sits on the chair 20, the distance between the head (the ears) of the listener 4 and each of the subwoofers 11SW1-11SW4 is about 20 centimeters.

The audio signal output device 3 supplies the respective channel audio signals to the subwoofers 11SW1-11SW4 via signal lines (speaker cable).

Figure 7:
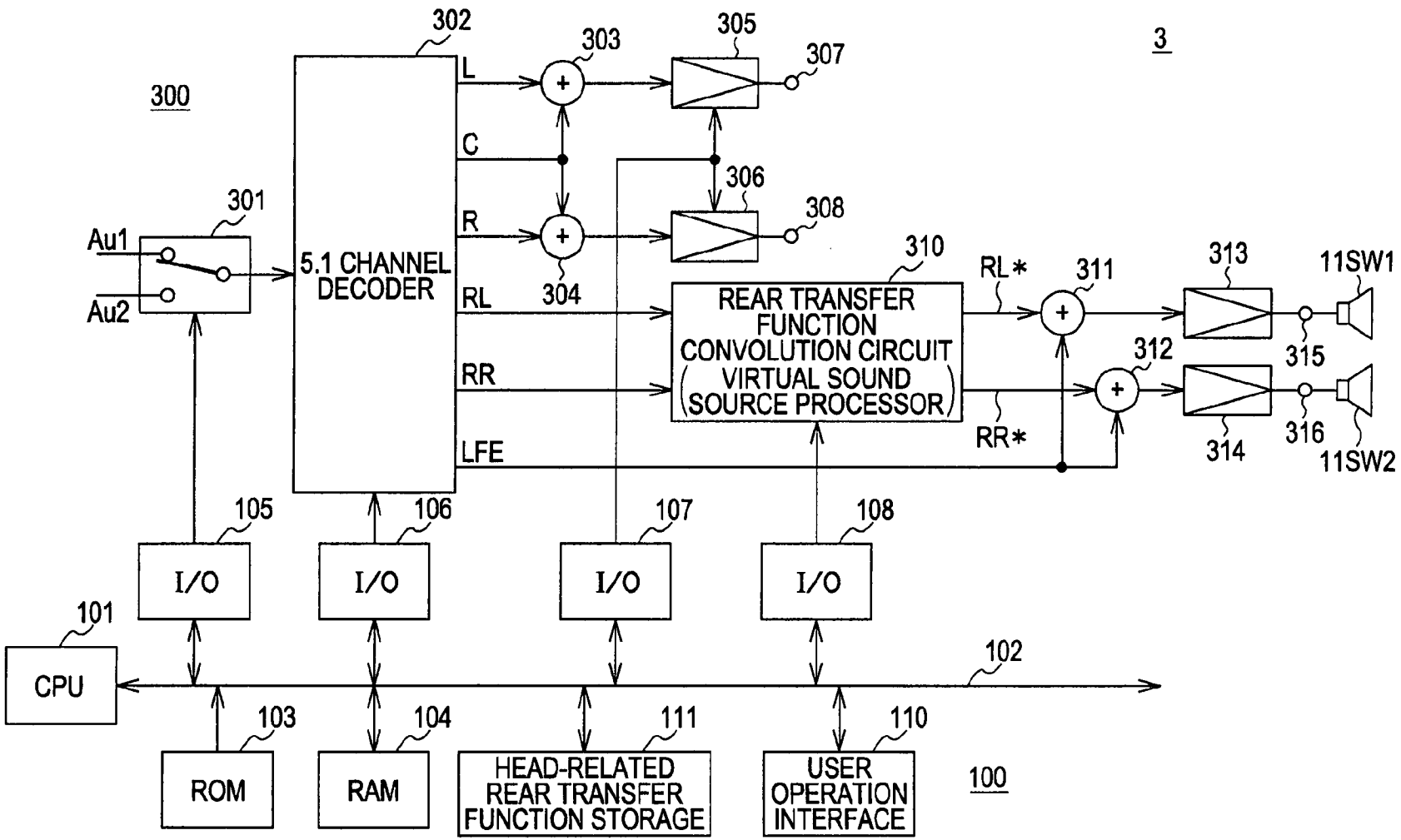
FIG. 7 is a block diagram of an audio signal output device in the audio reproducing system in accordance with the first embodiment of the present invention.

FIG. 7 is a block diagram of the audio signal output device 3 in accordance with the first embodiment of the present invention. The audio signal output device 3 of the first embodiment includes an audio signal processor 300 and a controller 100 including a microcomputer.

The controller 100 includes a central processing unit (CPU) 101. The controller 100 further includes a read-only memory (ROM) 103 storing a software program, a random-access memory (RAM) 104 serving as a working area for the CPU 101, a plurality of input-output ports 105-108, a user operation interface 110, a head-related rear transfer function storage 111, each element connected to the CPU 101 via a system bus 102. The user operation interface 110 includes a keyboard receiving inputs to the audio signal output device 3 and a remote control receiver communicating with a remote commander.

In accordance with the first embodiment, the audio signal output device 3 can receive the audio signal Au1 from the television receiver 1 and the audio signal Au2 from the DVD player 2. The audio signal Au1 and the audio signal Au2 are supplied to an input selection switch 301.

The input selection switch 301 performs a switching operation in response to a switch signal from the input-output interface 105 in the controller 100 when the a user enters an operational input to the user operation interface 110. When the user selects the audio signal from the television receiver 1, the input selection switch 301 selects the audio signal Au1. When the audio signal from the DVD player 2 is selected, the input selection switch 301 selects the audio signal Au2.

The audio signal selected by the input selection switch 301 is supplied to a 5.1 channel decoder 302. Upon receiving one of the audio signal Au1 and the audio signal Au2 from the input selection switch 301, the 5.1 channel decoder 302 decodes the selected audio signal, thereby outputting the front left and right channel audio signals L and R, the center channel audio signal C, the rear left and right channel audio signals RL and RR, and the low-frequency audio signal LFE.

The front left channel audio signal L and the center channel audio signal C, from the 5.1 channel decoder 302, are synthesized by a synthesizer 303, and the resulting synthesized output (L+C) is output to an audio output terminal 307 via an amplifier 305. The audio signal output to the audio output terminal 307 is then supplied to the one speaker 11FL in the television receiver 1.

The front right channel audio signal R and the center channel audio signal C, from the 5.1 channel decoder 302, are synthesized by a synthesizer 304. The resulting synthesized signal (R+C) is output to an audio output terminal 308 via an amplifier 306. The audio signal output to the audio output terminal 308 is then supplied to the other speaker 11FR in the television receiver 1.

The amplifiers 305 and 306 have a muting function for muting the audio signal outputs thereof, and mute the audio signal outputs thereof in response to a muting signal from the input-output interface 107 in the controller 100.

When the audio signal Au1 is received from the television receiver 1 in accordance with the first embodiment of the present invention, the audio signal reproduced by the television receiver 1 is output from the speakers 11FL and 11FR. The amplifiers 305 and 306 are mute controlled so that the audio signal from the audio signal output device 3 is not supplied to the speakers 11FL and 11FR in the television receiver 1.

When the audio signal Au2 is received from the DVD player 2, the amplifiers 305 and 306 are not mute controlled, thereby permitting the audio signal to be output to the speakers 11FL and 11FR in the television receiver 1.

Instead of the mute control on the amplifiers 305 and 306, the 5.1 channel decoder 302 may not output the front left and right channel audio signal L and R and the center channel audio signal C during the decoding of the audio signal from the television receiver 1. A control signal for this operation may be supplied from the input-output interface 106.

The rear left and right channel audio signal RL and RR decoded by the 5.1 channel decoder 302 are supplied to a rear transfer function convolution circuit 310 as a virtual sound source processor.

Using a digital filter, the rear transfer function convolution circuit 310 convolutes the rear left and right channel audio signal RL and RR from the 5.1 channel decoder 302 with a head-related rear transfer function prepared by a head-related rear transfer function storage 111.

The rear transfer function convolution circuit 310 converts the input audio signal into a digital signal if the input audio signal is not a digital signal, convolutes the digital signal with the head-related rear transfer function, and converts back the convoluted signal into an analog signal.

Figure 8:
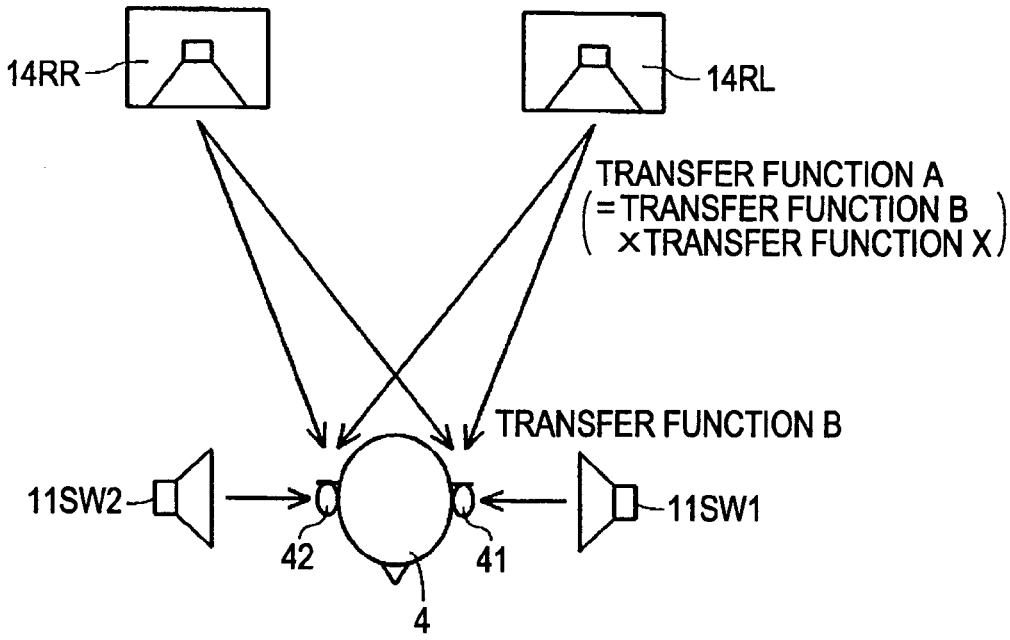
FIG. 8 is a diagram explaining a portion of the audio signal output device of FIG. 7.

The head-related rear transfer function is measured as described below and then stored on the head-related rear transfer function storage 111. FIG. 8 illustrates how the head-related rear transfer function is measured.

As shown in FIG. 8, a left channel measuring microphone 41 and a right channel measuring microphone 42 are arranged close to the left and right ears of the listener 4. The rear left channel speaker 11RL is arranged at a location behind the listener 4 where the rear left channel speaker 11RL is expected to be typically installed. For example, a sound emitted by the rear left channel speaker 11RL in response to an impulse is then picked up by the left channel measuring microphone 41 and the right channel measuring microphone 42. The transfer functions (the head-related rear transfer functions of the rear left channel) from the rear left channel speaker 11RL to the left and right ears of the listener 4 are measured from the picked up sounds.

Similarly, a sound emitted by the rear right channel speaker 11RR in response to an impulse is picked up by the microphones 41 and 42. The transfer functions (the head-related rear transfer functions of the rear right channel) from the rear right channel speaker 11RR to the left and right ears of the listener 4 are measured from the picked up sounds.

The front speaker RL is positioned about 2 meters apart behind the listener 4 in a line angled by about 30 degrees clockwise from the fore-aft line of the listener 4 in a plan view and the front speaker RR is positioned about 2 meters apart behind the listener 4 in a line angled by about 30 degrees counterclockwise from the fore-aft line of the listener 4 in a plan view. With this set-up, the transfer functions from each speaker to each ear is measured.

The transfer function is further discussed. A transfer function from left behind to the left ear is referred to as a transfer function A. A transfer function measured from the speaker 11SW1 in the vicinity of the ear to the microphone 41 is referred to as a transfer function B. A transfer function X is determined on the premise that the transfer function B multiplied by the transfer function X results in the transfer function A. If the signal supplied to the close speaker 11SW1 is convoluted with the determined transfer function X, the sound emitted from the speaker 11SW1 is felt as if the sound comes from 2 meters behind the listener 4.

The determination of the transfer function X is not necessarily required. Only the transfer function A may be occasionally sufficient. In the above discussion, a single transfer function has been discussed. In practice, a plurality of transfer functions are used as shown in FIG. 8.

The head-related rear transfer function is stored on the head-related rear transfer function storage 111. The head-related rear transfer function is then supplied to the rear transfer function convolution circuit 310 via the input-output interface 108 and is used to convolute the rear left and right channel audio signal RL and RR with the head-related rear transfer function. When the rear transfer function convolution circuit 310 supplies the rear left and right channel audio signals RL* and RR* to the speakers 11SW1 and 11SW2 arranged in close vicinity of the ears of the listener 4, respectively, the listener 4 can hear the sounds from the speakers 11SW1 and 11SW2 as if he hears the sounds from the rear left and right channel speakers 11RL and 11RR.

The level of each of the rear left and right channel audio signal RL and RR virtual sound imaged may be lower than the level of those supplied to the rear left and right channel speakers 11RL and 11RR. This is because the speakers 11SW1 and 11SW2 are arranged close to the ears of the listener 4.

The above process is also referred to as a virtual sound source process because a sound is heard as if the sound is emitted from a virtual speaker as a result of the above-described head-related transfer function convolution.

In this way, the rear transfer function convolution circuit 310 supplies the virtual sound imaged, rear left and right channel audio signals RL* and RR* to synthesizers 311 and 312 respectively. The synthesizers 311 and 312 are supplied with the low-frequency audio signal LFE from the 5.1 channel decoder 302. The output audio signals from the synthesizers 311 and 312 are output to audio output terminals 315 and 316 via amplifiers 313 and 314, respectively.

The audio output terminals 315 and 316 are connected to the speakers 11SW1 and 11SW2, respectively, arranged close to the ears of the listener 4. The speakers 11SW1 and 11SW2, functioning as the subwoofers, reproduce the low-frequency audio signal LFE while reproducing the virtual sound imaged, rear left and right channel audio signals RL* and RR* at the same time.

The audio signal Au1 from the television receiver 1 is decoded by the 5.1 channel decoder 302 for sound reproduction. In this case, it should be noted that the sounds output from the speakers 11FL and 11FR contain the rear left and right channel sounds.

More specifically, the sound image localization of the rear left and right channel sounds output from the speakers 11SW1 and 11SW2 arranged in the vicinity of the ears of the listener 4 can be affected by the rear left and right channel sounds contained in the sounds emitted from the speakers 11FL and 11FR in the television receiver 1.

In accordance with the first embodiment, the speakers 11SW1 and 11SW2 are arranged in the vicinity of the ears of the listener 4 and are thus much closer to the ears of the listener 4 than the speakers 11FL and 11FR in the television receiver 1. The sound emitted from the speakers 11SW1 and 11SW2 reach the listener 4 much earlier than the sounds from the speakers 11FL and 11FR in the television receiver 1.

With the Haas effect, the listener 4 listens to only the sounds from the speakers 11SW1 and 11SW2 as the rear sounds. It is thus not necessary to remove the rear left and right channel audio signals from the audio signals supplied to the speakers 11FL and 11FR in the television receiver 1.

The audio signal system to be supplied to the auxiliary subwoofers 11SW3 and 11SW4 is not shown in FIG. 7. As previously discussed, only the low-frequency audio signal LFE may be supplied to the auxiliary subwoofers 11SW3 and 11SW4. Optionally, the virtual sound imaged, rear left and right channel audio signals RL and RR may be supplied to the auxiliary subwoofers 11SW3 and 11SW4 in addition to the low-frequency audio signal LFE.

In accordance with the audio reproducing system of the first embodiment with the multi-channel speakers mounted to the chair 20 of FIG. 5, the listener 4 sitting on the chair 20 can enjoy a high-volume level and presence-rich multi-channel sound with the speakers of the number smaller than the number of channels while substantially reducing the leakage of sound to the ambient environment.

In accordance with the first embodiment, the subwoofers 11SW1 and 11SW2 not housed in boxes and arranged in the vicinity of the ears of the listener 4 substantially reduce the powerful low-frequency sound from being leaked to next rooms. The rear left and right channel sounds for the speakers other than the subwoofers are virtual sound imaged and then output from the speakers 11SW1 and 11SW2. The audio signal at a low level thus works. Not only the low-frequency sound but also other frequency sound are reproduced at the leakage level thereof to the ambient environment controlled. Without worrying about other persons, the listener 4 can fully enjoy DVD even at midnight.

Since the speakers 11SW1 and 11SW2 are arranged in the vicinity of the ears of the listener 4, the audio output power can be reduced to about 1/100 of the known art. Power saving is performed and the cost involved in hardware (such as an output amplifier) is reduced. Since a small audio output power works, the speaker requires no large stroke. A thin, light, and low-cost designed speaker suffices. With a small audio output power, heat generation is reduced, thereby permitting a power supply of compact design to be used. Battery operation is also possible. The apparatus can be embedded in the chair.

The audio reproducing system of the first embodiment of the present invention generally saves energy without lowering satisfaction level of the listener 4 while reducing the noise leaking out to the ambient environment.

A typical soundproof window attenuates sound by about 45 dB at 5 kHz, 36 dB at 1 kHz, and down to 20 dB at 100 Hz. Below 100 Hz, the degree of attenuation of sound is lowered. The effectiveness of the sound isolation of the subwoofers is much more pronounced than the effectiveness of the soundproof window. This is even more so when considering costs involved in the deafening of the room if a user does so to enjoy audio-visual content.

In accordance with the first embodiment of the present invention, the audio signal Au2 is supplied to the speakers 11FL and 11FR in the television receiver 1 via the audio signal output device 3 when the DVD player 2 is used. As when a digital broadcast program is received, the audio signal Au2 from the DVD player 2 may be supplied to the television receiver 1 so that the sounds containing the 5.1 channel sound are output from the speakers 11FL and 11FR. In such an operation, an audio signal line extending from the audio signal output device 3 to the speakers 11FL and 11FR becomes unnecessary.

The audio signal output device 3 may be installed in a predetermined position below the seat surface of the chair 20. In such an installation, the audio signal output device 3 can receive the audio signal Au2 from one of the television receiver 1 and the DVD player 2, as a source of the multi-channel audio signal, via a signal cable. The signal cable is extended between the chair 20 and one of the television receiver 1 and the DVD player 2. The signal cable between the chair 20 and one of the television receiver 1 and the DVD player 2 may be eliminated by arranging means in the DVD player 2 for cordlessly transmitting the multi-channel audio signal by means of radiowave or light and a receiver in the audio signal output device 3 cordlessly receiving the multi-channel audio signal by means of radiowave or light.

When the multi-channel audio signal is output from the multi-channel audio source such as the DVD player 2 in the form of radiowave or light, the link between the DVD player 2 and the audio reproducing system becomes cordless, and the chair 20 is freely movable.

Second Embodiment

In accordance with the first embodiment of the present invention, the front left and right channel speakers are the speakers 11FL and 11FR in the television receiver 1. In contrast, an audio reproducing system in accordance with a second embodiment of the present invention, the front left and right channel speakers are two separate speakers 51FL and 51FR.

Figure 9:
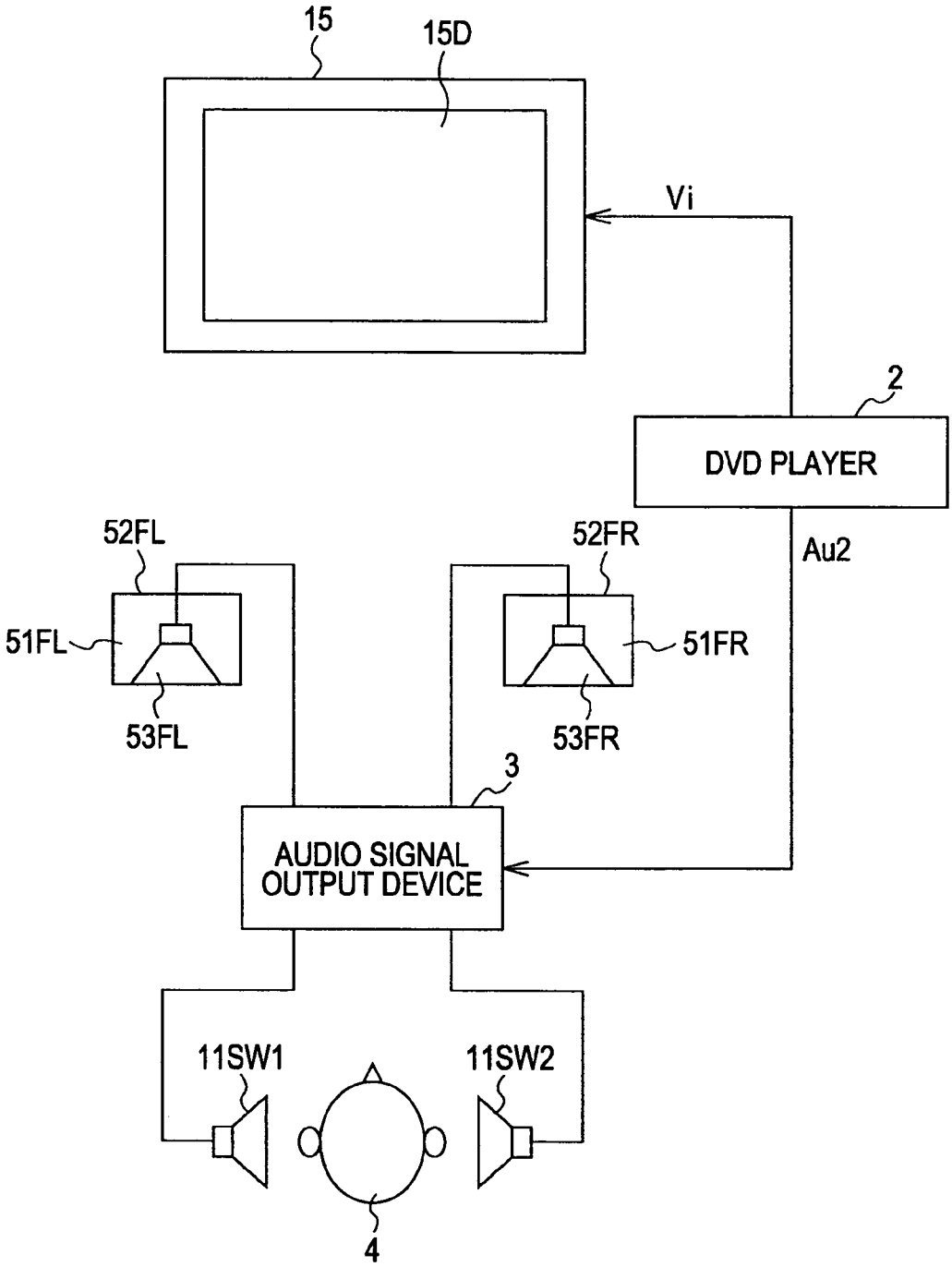
FIG. 9 is a block diagram of an audio reproducing system in accordance with a second embodiment of the present invention.

As shown in FIG. 9, the speaker 51FL includes a speaker box 52FL and a speaker unit 53FL housed in the speaker box 52FL. The speaker unit 53FL is secured to a front panel of the speaker box 52FL serving as a baffle board thereof. The speaker 51FR includes a speaker box 52FR and a speaker unit 53FR housed in the speaker box 52FR. The speaker unit 53FR is secured to a front panel of the speaker box 52FR serving as a baffle board thereof.

In accordance with the second embodiment, the video signal Vi from the DVD player 2 is supplied to a display monitor 15 separated from the speakers rather than to the television receiver 1, and displayed on a display screen 15D of the display monitor 15.

Figure 10:
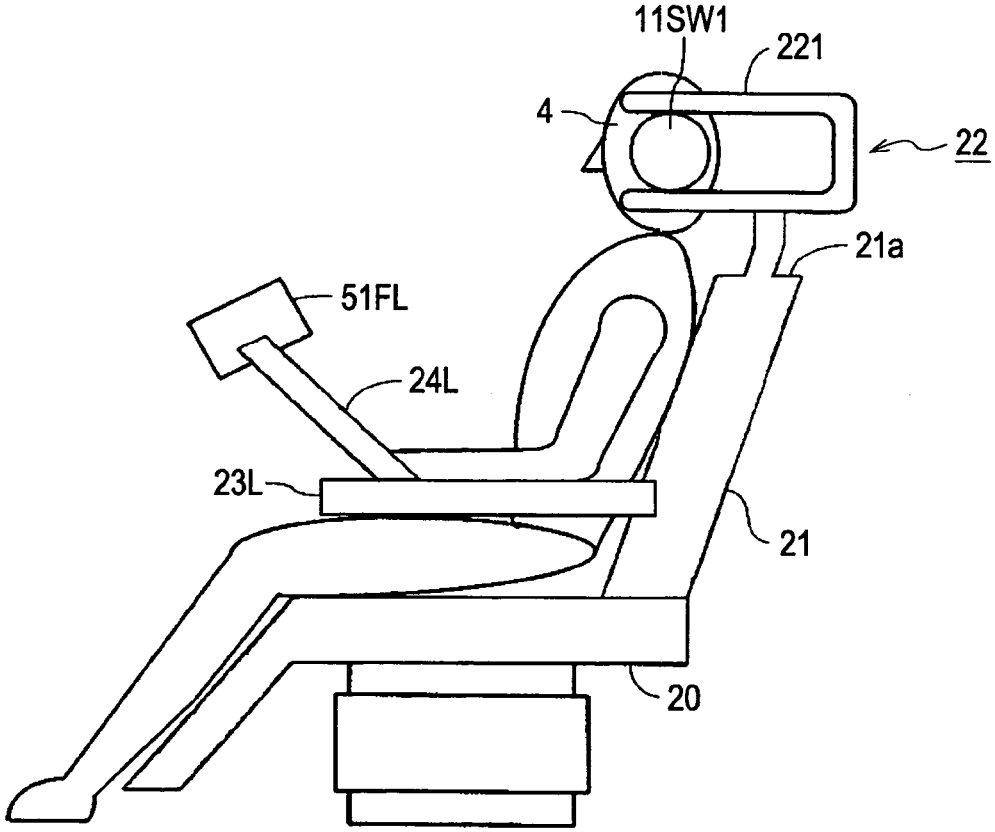
FIG. 10 illustrates a speaker mounting example in the audio reproducing system in accordance with the second embodiment of the present invention.

The two speakers 51FL and 51FR may be installed at any location. In accordance with the second embodiment, the speakers 51FL and 51FR are mounted on the chair 20 as shown in FIG. 10.

In accordance with the second embodiment, the front left channel speaker 51FL is mounted on an end of an arm 24L detachably mounted on a left arm rest 23L of the chair 20. The left arm rest 23L includes a mounting block (not shown) that permits the arm 24L to be detachably supported. The arm 24L supporting at the end thereof the speaker 51FL is mounted to the mounting block, and thus secured to the chair 20. The speaker 51FL is positioned to be clear of the vision of the listener 4 watching the video on the display screen.

The front right channel speaker 51FR (not shown) is similarly mounted to an end of an arm. The arm is connected to a mounting block of a right arm rest of the chair 20.

In accordance with the second embodiment, the audio signal output device 3 of FIG. 3 needs no input selection switch 301. The mute control function to the amplifiers 305 and 306 is also unnecessary. The audio signals output to the audio output terminals 307 and 308 are respectively supplied to the front left and right channel speakers 51FL and 51FR.

The rest of the second embodiment remains unchanged from the first embodiment.

In accordance with the second embodiment, the front left and right channel speakers 51FL and 51FR are arranged relatively close to the listener 4, and a volume level of the sounds from the speakers 51FL and 51FR lowered than in the speakers 11FL and 11FR in the first embodiment works. The audio reproducing system of the second embodiment thus serves more the sound isolation purposes.

Third Embodiment

In accordance with the first and second embodiments, the audio reproducing system virtual sound images the rear left and right channel audio signals, permitting the number of speakers in use to be reduced, and the sound isolation to be achieved. Even if the rear speakers are placed relatively close to the listener 4, the surround effect and low-noise feature are not degraded.

In accordance with a third embodiment of the present invention, real rear speakers are arranged close to the listener 4. The audio signal to be supplied to the front left and right channel speakers are virtual sound imaged and then supplied to two speakers 11SW1 and 11SW2 arranged close to the ears of the listener 4. The two front left and right channel speakers are thus eliminated.

Figure 11:
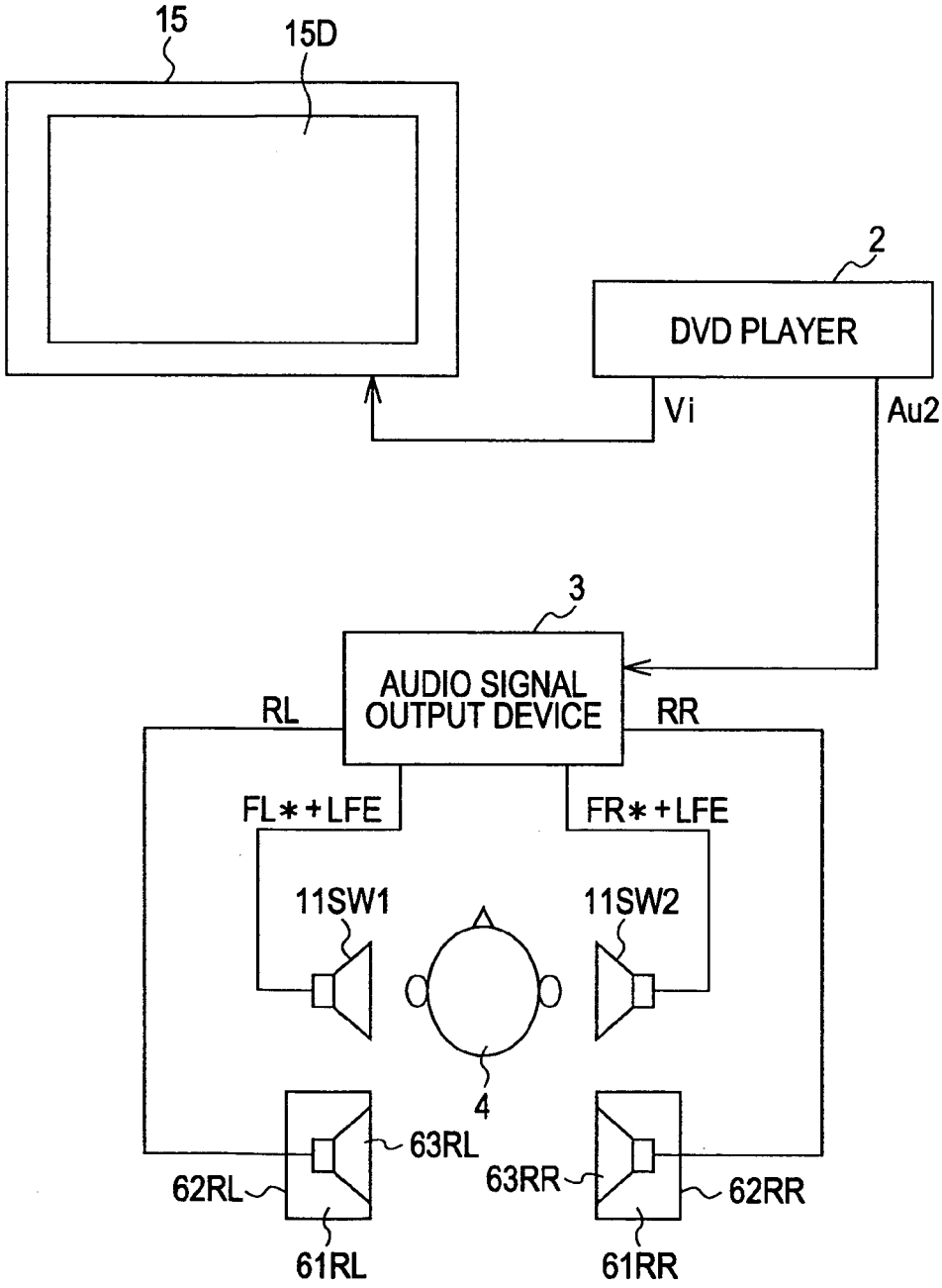
FIG. 11 is a block diagram of an audio reproducing system in accordance with a third embodiment of the present invention.

FIG. 11 illustrates the audio reproducing system of the third embodiment of the present invention. As in the second embodiment as shown in FIG. 11, the video signal Vi from the DVD player 2 is supplied to the display monitor 15 to show the corresponding video on the display screen 15D.

Not only the speakers 11SW1 and 11SW2 as the subwoofers but also two rear left and right channel speakers 61RL and 61RR are arranged close to the ears of the listener 4. As shown in FIG. 11, the speaker 61RL includes a small speaker box 62RL and a rear left speaker unit 63RL housed in the speaker box 62RL. The speaker unit 63RL is secured to a front panel of the speaker box 62RL serving as a baffle board thereof. The speaker 61RR includes a small speaker box 62RR and a rear right speaker unit 63RR housed in the speaker box 62RR. The speaker unit 63RR is secured to a front panel of the speaker box 62RR serving as a baffle board thereof.

Only the audio signal Au2 is supplied to the audio signal output device 3 from the DVD player 2. The audio signal output device 3 produces the low-frequency audio signal LFE to be supplied to the subwoofers 11SW1 and 11SW2 (also to the auxiliary subwoofers 11SW3 and 11SW4 depending on the set-up) and the rear left and right channel audio signals RL and RR to be supplied to the rear left and right channel speakers 61RL and 61RR, respectively. The audio signal output device 3 also virtual sound images the front left and right channel audio signals L and R into the audio signals FL* and FR*, and supplies the audio signals FL* and FR* to the subwoofers 11SW1 and 11SW2, respectively. The center channel audio signal C is synthesized into each of the front left and right channel audio signals L and R to be virtual sound imaged.

Figure 12:
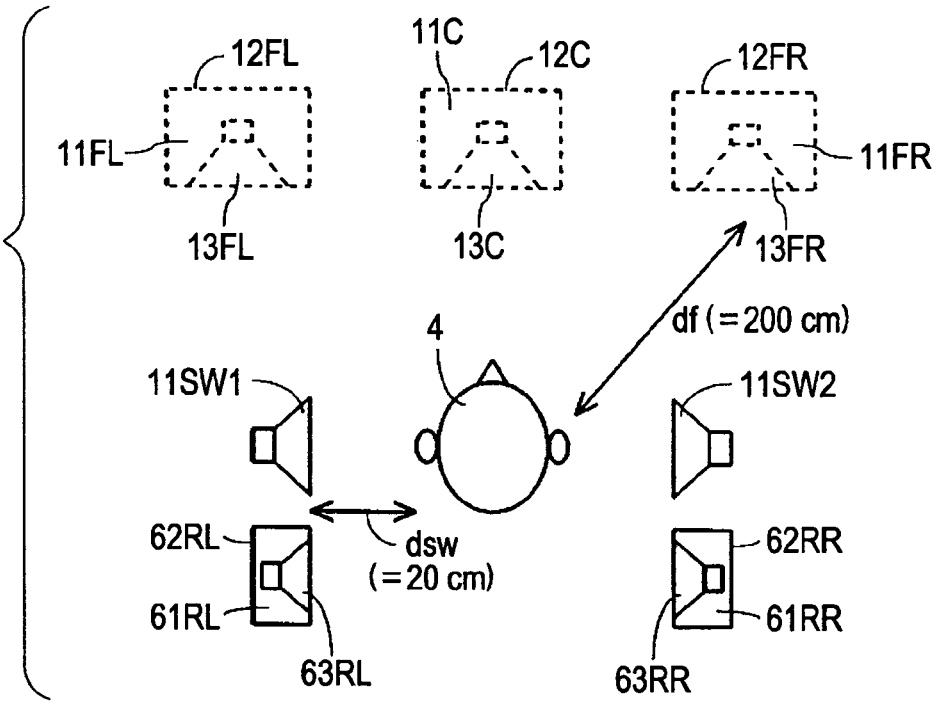
FIG. 12 illustrates a speaker placement configuration in the audio reproducing system in accordance with the third embodiment of the present invention.

FIG. 12 illustrates a speaker placement configuration of the third embodiment of the present invention. In accordance with the third embodiment, as represented by solid outlines, the real speakers include the two subwoofers 11SW1 and 11SW2 arranged close to the ears of the listener 4 and the two rear left and right speakers 61RL and 61RR. As previously discussed, not only the speakers 11SW1 and 11SW2 but also the rear left and right channel speakers 61RL and 61RR are spaced from the listener 4 by a distance dsw=about 20 cm.

The center channel speaker 11C and the front left and right channel speaker 11FL and 11FR, represented by broken outlines, are not employed as shown in FIG. 12. The audio signal to be supplied to the speakers is virtual sound imaged, and then supplied to the speakers 11SW1 and 11SW2. These speakers reproduce the sound so that the listener 4 feels as if the speakers are present as represented by the broken lines.

The center channel audio signal is added to the front left and right channel audio signals, and the front left and right channel audio signals having the center channel audio signal combined therewith are virtual sound imaged. The listener 4 feels as if he hears the center channel audio from the position of the center channel speaker 11C represented by the broken outline.

As the first and second embodiments of the present invention, the third embodiment may be applied to the structure of a massage chair. Such an application is described below.

Figure 13:
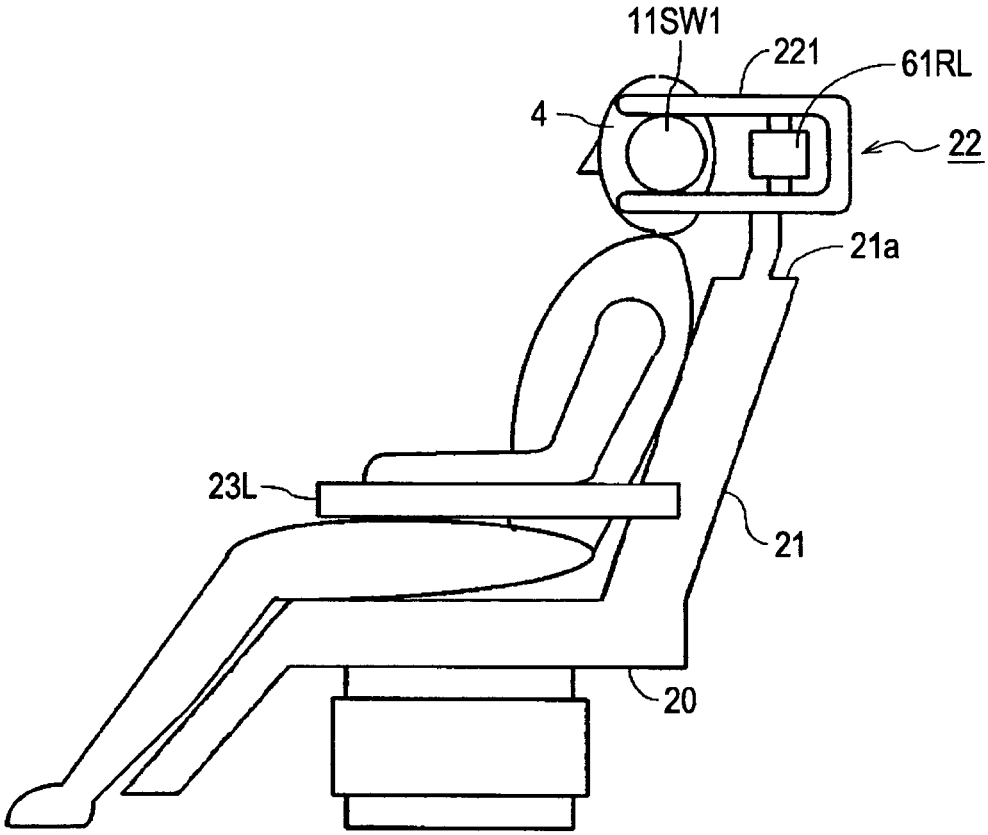
FIG. 13 illustrates a speaker mounting example in the audio reproducing system in accordance with the third embodiment of the present invention.

FIG. 13 illustrates the audio reproducing system of the third embodiment mounted on the chair 20. The rear left and right channel speakers 61RL and 61RR in addition to the subwoofers 11SW1 and 11SW2 are mounted on the chair 20. Elements identical to those of the first embodiment are designated with the same reference numerals and the discussion thereof is omitted herein.

Figure 14A:
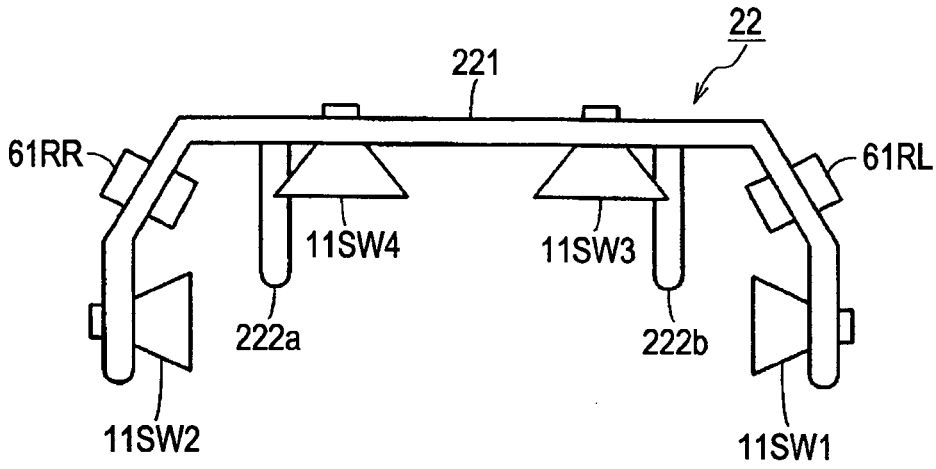
FIGS. 14A and 14B illustrates speakers mounted in the audio reproducing system in accordance with the third embodiment of the present invention.
Figure 14B:
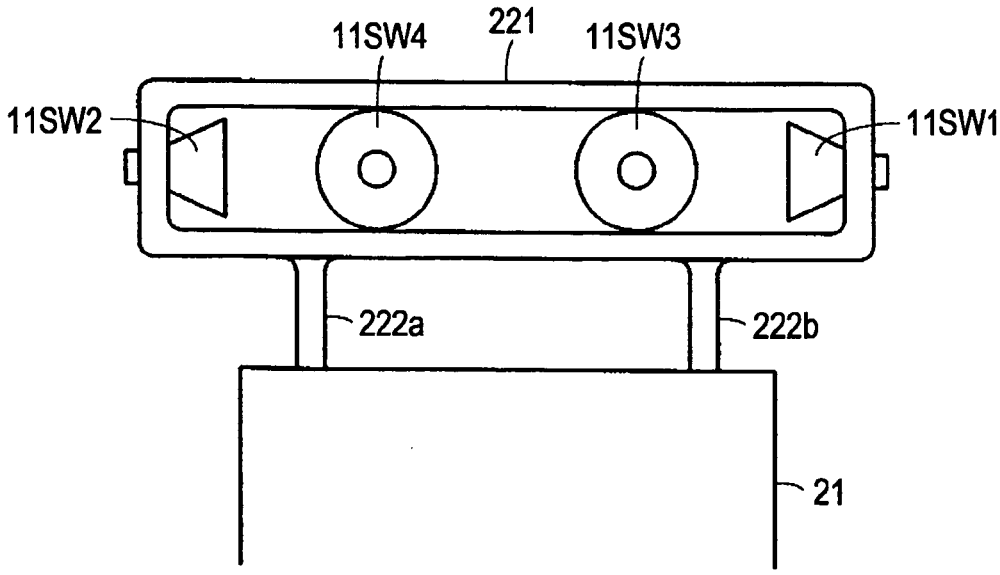

As shown in FIG. 13 and FIGS. 14A and 14B, the rear left and right channel speakers 61RL and 61RR are mounted to the speaker holder 22 together with the subwoofers 11SW1 and 11SW2. More specifically, the rear left and right channel speakers 61RL and 61RR are supported within space defined by a flattened ring configuration of the speaker holder 22 behind the head of the listener 4, at respective angles from the fore-aft line of the listener 4 in plan view.

As in the first embodiment, the auxiliary subwoofers 11SW3 and 11SW4 are also mounted.

When the listener 4 sits on the chair 20, the distance between the head (or the ears) of the listener 4 and the corresponding subwoofers 11SW1-11SW4 and speakers 11RL and 11RR about 20 centimeters.

Figure 15:
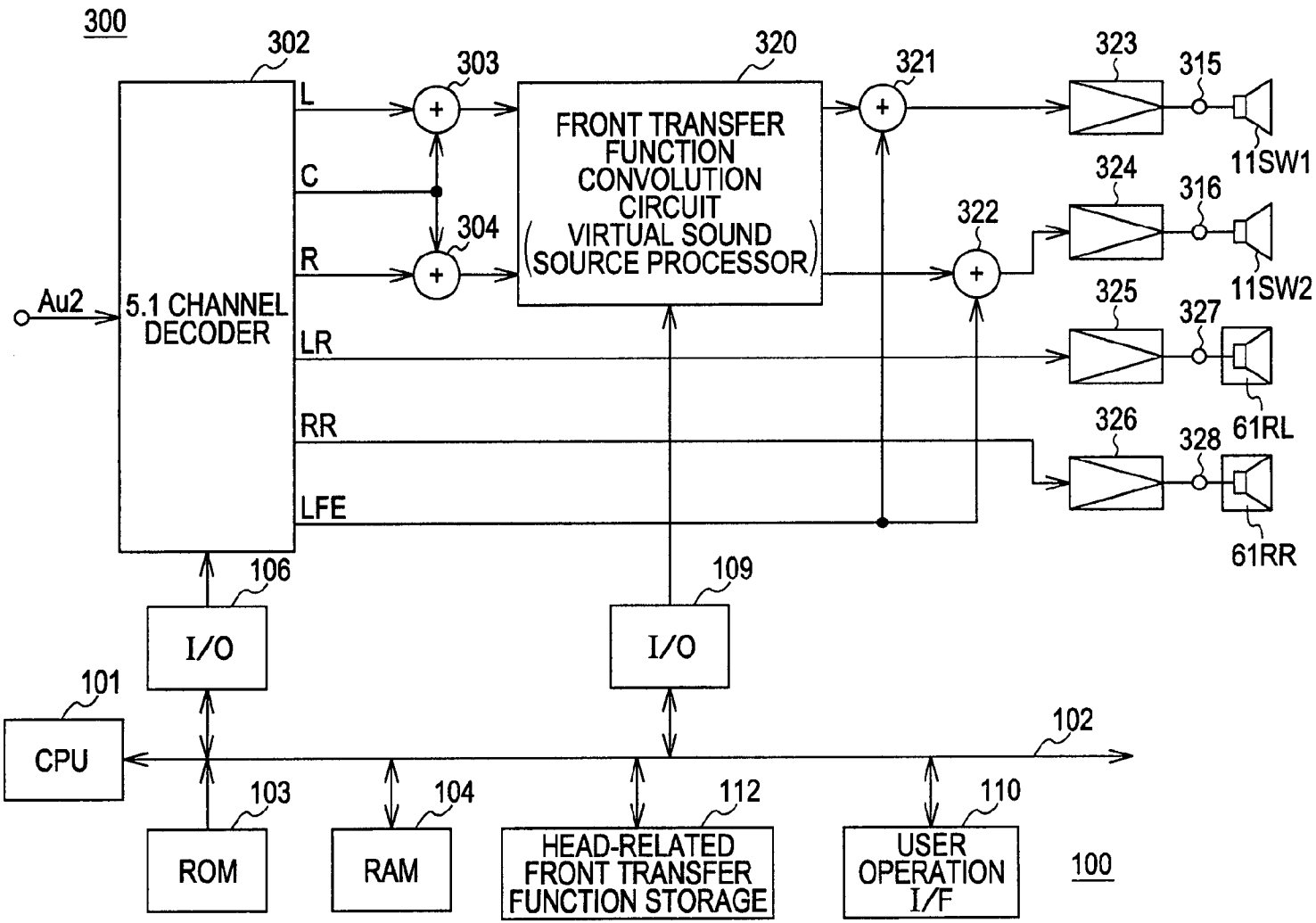
FIG. 15 is a block diagram of an audio signal output device in the audio reproducing system in accordance with the third embodiment of the present invention.

FIG. 15 is a block diagram of the audio signal output device 3 in accordance with the third embodiment of the present invention. As the audio signal output device 3 of the first embodiment, the audio signal output device 3 of the third embodiment includes the audio signal processor 300 and the controller 100.

The controller 100 of the third embodiment is different from the controller 100 of the first embodiment in that a head-related front transfer function storage 112 is used instead of the head-related rear transfer function storage 111. The rest of the controller 100 remains unchanged from the controller 100 of the first embodiment.

The input selection switch 301 of the first embodiment is eliminated from the audio signal processor 300 of the third embodiment. As in the first embodiment, the audio signal processor 300 of the third embodiment includes the 5.1 channel decoder 302 and a front transfer function convolution circuit 320 instead of the rear transfer function convolution circuit 310 of the first embodiment.

Upon receiving the audio signal Au2 from the DVD player 2, the 5.1 channel decoder 302 decodes the audio signal Au2, thereby outputting the front left and right channel audio signals L and R, the center channel audio signal C, the rear left and right channel audio signals RL and RR, and the low-frequency audio signal LFE.

The front left channel audio signal L and the center channel audio signal C, from the 5.1 channel decoder 302, are synthesized into a synthesized output signal (L+C) by a synthesizer 303. The synthesized output signal is then supplied to the front transfer function convolution circuit 320 as a virtual sound source processor. The front right channel audio signal R and the center channel audio signal C, from the 5.1 channel decoder 302, are synthesized into a synthesized output signal (R+C) by a synthesizer 304. The synthesized output signal is then supplied to the front transfer function convolution circuit 320.

The front transfer function convolution circuit 320 is identical in structure to the rear transfer function convolution circuit 310. Using a digital filter, the front transfer function convolution circuit 320 convolutes the audio signals from the synthesizer 303 and the synthesizer 304 with a head-related transfer function pre-stored on a head-related front transfer function storage 112.

The front transfer function convolution circuit 320 converts the input audio signal into a digital signal if the input audio signal is not a digital signal, convolutes the digital signal with the head-related front transfer function, and converts back the convoluted signal into an analog signal.

Figure 16:
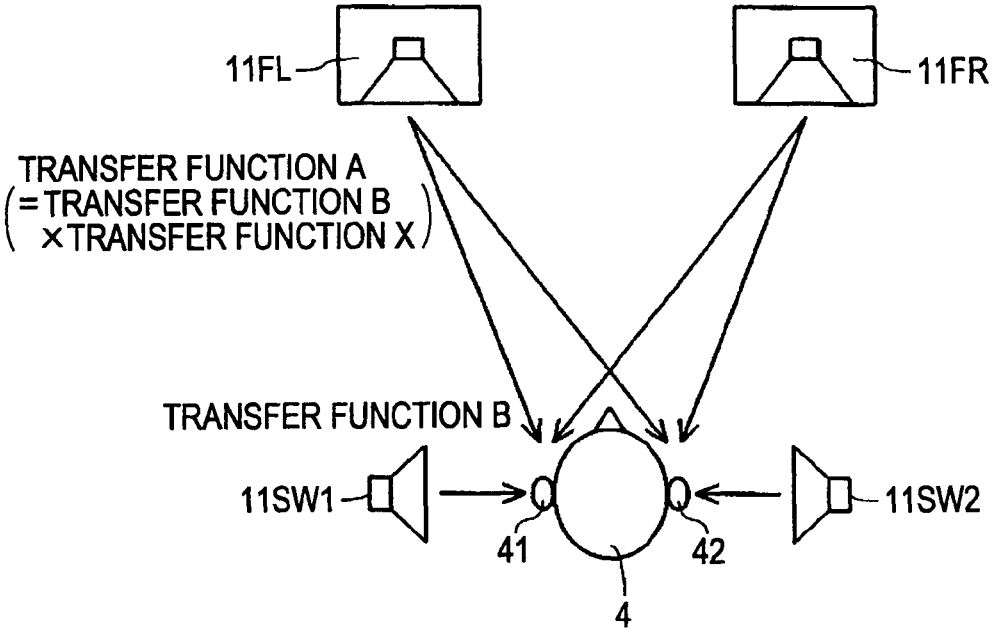
FIG. 16 is a diagram explaining a portion of the audio signal output device of FIG. 15.

The head-related front transfer function is measured as described below and then stored on the head-related front transfer function storage 112. FIG. 16 illustrates how the head-related front transfer function is measured.

As shown in FIG. 16, a left channel measuring microphone 41 and a right channel measuring microphone 42 are arranged close to the left and right ears of the listener 4, respectively. The front left channel speaker 11FL is arranged at a location in front of the listener 4 where the front left channel speaker 11FL is expected to be typically installed. For example, a sound emitted by the front left channel speaker 11FL in response to an impulse is then picked up by the left channel measuring microphone 41 and the right channel measuring microphone 42. The transfer functions (the head-related front transfer functions of the front left channel) from the front left channel speaker 11FL to the left and right ears of the listener 4 are measured from the picked up sounds.

Similarly, a sound emitted by the front right channel speaker 11FR in response to an impulse is picked up by the microphones 41 and 42. The transfer functions (the head-related front transfer functions of the front right channel) from the front right channel speaker 11FR to the left and right ears of the listener 4 are measured from the picked up sounds.

The front speaker FL is positioned about 2 meters apart ahead of the listener 4 in a line angled by about 30 degrees counterclockwise from the fore-aft line of the listener 4 in a plan view and the front speaker FR is positioned about 2 meters apart ahead of the listener 4 in a line angled by about 30 degrees clockwise from the fore-aft line of the listener 4 in a plan view. With this set-up, the transfer functions from each speaker to each ear is measured.

The transfer function is further discussed. A transfer function from front left to the left ear is referred to as a transfer function A as shown in FIG. 16. A transfer function measured from the speaker 11SW1 in the vicinity of the ear to the microphone 41 is referred to as a transfer function B. A transfer function X is determined on the premise that the transfer function B multiplied by the transfer function X results in the transfer function A. If the signal supplied to the close speaker 11SW1 is convoluted with the determined transfer function X, the sound emitted from the speaker 11SW1 is felt as if the sound comes from 2 meters left ahead of the listener 4.

The determination of the transfer function X is not necessarily required. Only the transfer function A may be occasionally sufficient. In the above discussion, a single transfer function has been discussed. In practice, a plurality of transfer functions is used in FIG. 16.

The head-related front transfer function is stored on the head-related front transfer function storage 112. The front transfer function convolution circuit 320 convolutes the audio signals with the head-related front transfer function supplied via an input-output port 109. The front transfer function convolution circuit 320 outputs the virtual sound imaged, front left channel audio signal FL* with the center channel audio signal C synthesized therewith, and the virtual sound imaged, front right channel audio signal FR* with the center channel audio signal C synthesized therewith.

The front transfer function convolution circuit 320 supplies the audio signals (FL*+C) and (FR*+C) to the speakers 11SW1 and 11SW2 arranged close to the ears of the listener 4. The listener 4 feels as if the sounds output from the speakers 11SW1 and 11SW2 are emitted from the front left and right channel speaker 11FL and 11FR and as if the center channel sound is emitted from the center speaker.

The level of the audio signals (FL*+C) and (FR*+C) may be lower than the level of those supplied to the rear left and right channel speakers 11RL and 11RR because the speakers 11SW1 and 11SW2 are arranged close to the ears of the listener 4.

In this way, the front transfer function convolution circuit 320 supplies the virtual sound imaged, audio signals (FL*+C) and (FR*+C) to the synthesizers 321 and 322, respectively. The synthesizers 321 and 322 are supplied with the low-frequency audio signal LFE from the 5.1 channel decoder 302. The output audio signals from the synthesizers 321 and 322 are output to audio output terminals 315 and 316 via amplifiers 323 and 324, respectively.

The audio output terminals are connected to the subwoofers 11SW1 and 11SW2 arranged close to the ears of the listener 4. As the subwoofers, the speakers 11SW1 and 11SW2 reproduces the low-frequency audio signal LFE while also reproducing the virtual sound imaged, audio signals (FL*+C) and (FR*+C).

The audio signal system to be supplied to the auxiliary subwoofers 11SW3 and 11SW4 is not shown in FIG. 15. As previously discussed, only the low-frequency audio signal LFE may be supplied to the auxiliary subwoofers 11SW3 and 11SW4. Optionally, the virtual sound imaged, audio signals (FL*+C) and (FR*+C) may be supplied to the auxiliary subwoofers 11SW3 and 11SW4 in addition to the low-frequency audio signal LFE.

In accordance with the third embodiment, the rear left and right channel audio signals RL and RR from the 5.1 channel decoder 302 are output to audio output terminals 327 and 328 via amplifiers 325 and 326, respectively. The rear left and right channel audio signals RL and RR are thus output in sound by the rear left and right channel speakers 61RL and 61RR connected to the audio signal terminals 327 and 328, respectively.

Since the rear left and right channel speakers 61RL and 61RR are arranged close to the ears of the listener 4 in accordance with the third embodiment, the rear left and right channel audio signals RL and RR supplied thereto at a low level works.

As in the first and second embodiments, the listener 4 can enjoy a high-volume level and presence-rich multi-channel sound with the speakers of the number smaller than the number of channels while substantially reducing the leakage of sound to the ambient environment in accordance with the third embodiment. The audio reproducing system also achieves energy saving.

In accordance with the third embodiment, the audio reproducing system employs no front speakers, and the audio signals are virtual sound imaged and then supplied to the speakers 11SW1 and 11SW2 arranged close to the ears of the listener 4. Sound leakage to the ambient environment is even more reduced.

Fourth Embodiment

In accordance with a fourth embodiment, sound isolation and energy saving performance is maximized by allowing all 5.1 channel surround sounds to be output from the two speakers 11SW1 and 11SW2 arranged close to the ears of the listener 4.

Figure 17:
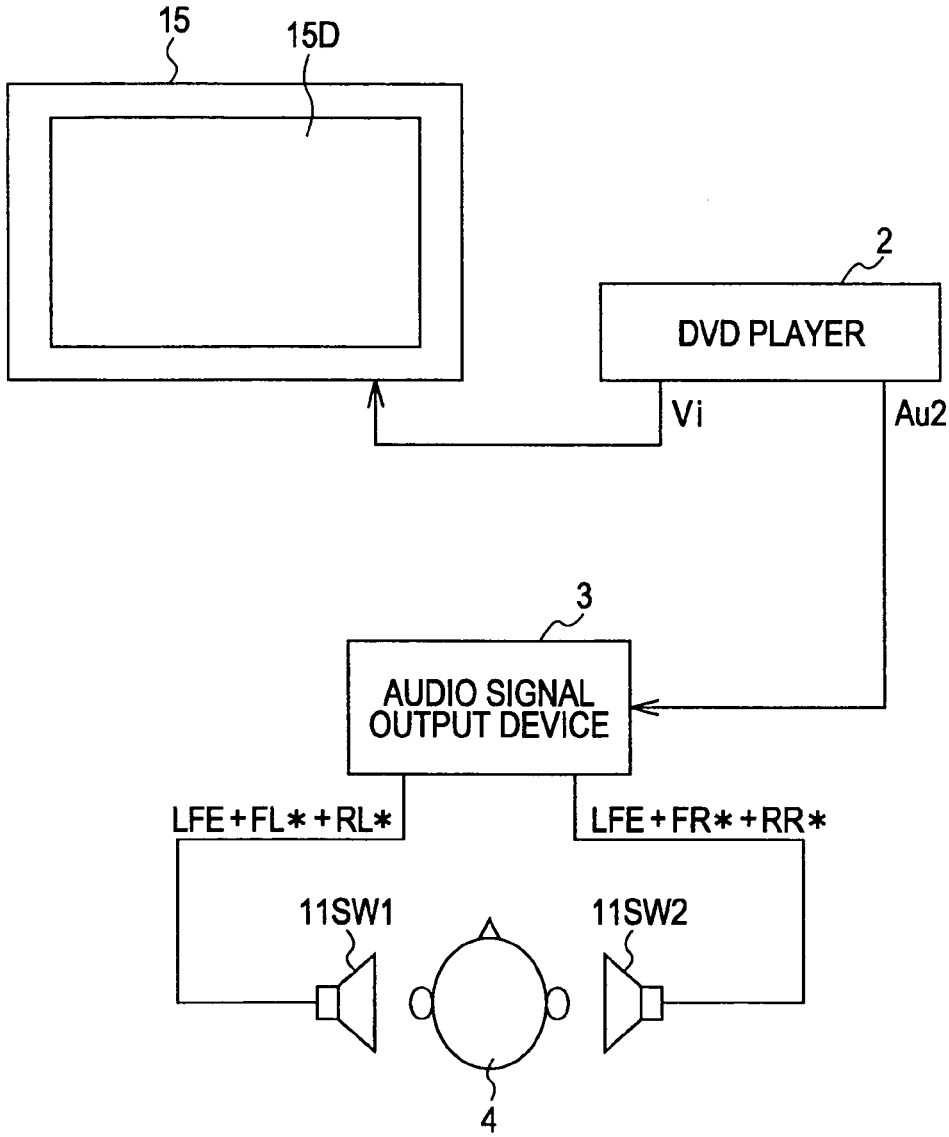
FIG. 17 is a block diagram illustrating an audio reproducing system in accordance with a fourth embodiment of the present invention.

FIG. 17 illustrates an audio reproducing system in accordance with the fourth embodiment of the present invention. As shown in FIG. 17, the video signal Vi from the DVD player 2 is supplied to the display monitor 15 to display a video on the display screen 15D as in the second and third embodiments.

The subwoofers 11SW1 and 11SW2 only are arranged close to the listener 4.

The audio signal output device 3 receives only the audio signal Au2 from the DVD player 2. In response to the audio signal Au2, the audio signal output device 3 produces the low-frequency audio signal LFE to be supplied to the subwoofers 11SW1 and 11SW2 (also to the auxiliary subwoofers 11SW3 and 11SW4 depending on the set-up), the front left and right channel audio signals FL and FR, and the rear left and right channel audio signals RL and RR. The audio signal output device 3 also virtual sound images each of the produced signals and then the virtual sound imaged signals to the subwoofers 11SW1 and 11SW2. The center channel audio signal C is synthesized with each of the front left and right channel audio signals L and R to be virtual sound imaged.

Figure 18:
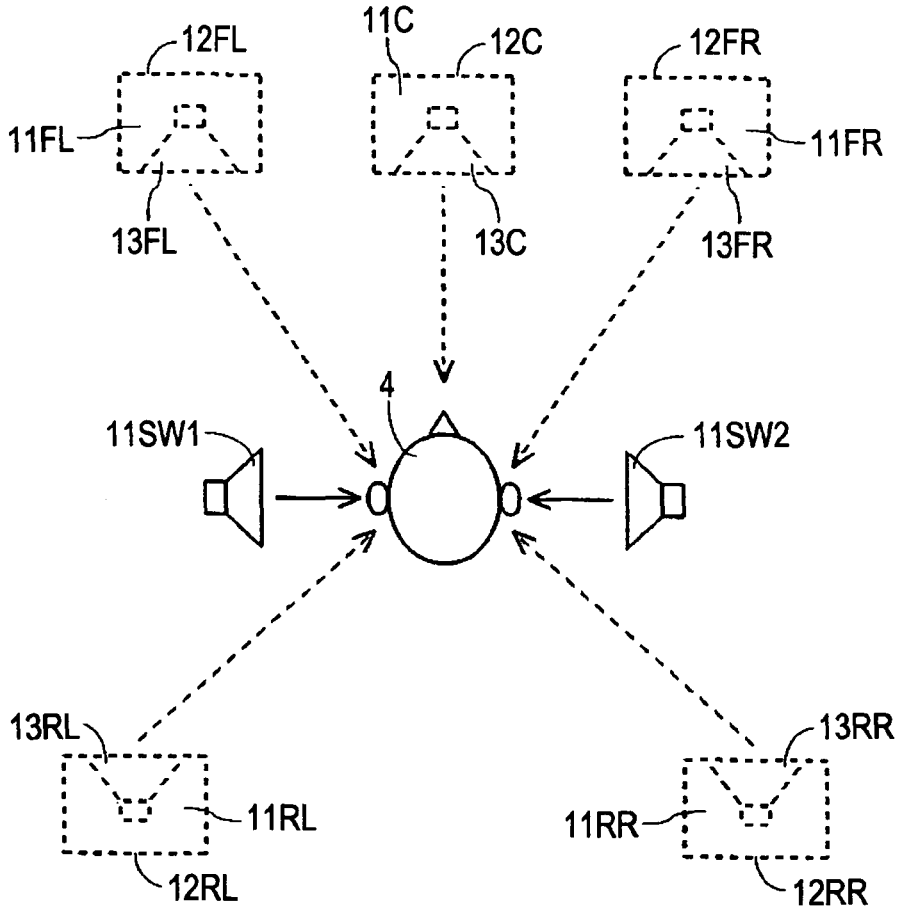
FIG. 18 illustrates a speaker placement configuration in the audio reproducing system in accordance with the third embodiment of the present invention.

FIG. 18 illustrates a speaker placement configuration of the fourth embodiment. In accordance with the fourth embodiment, speakers in use are only the two speakers 11SW1 and 11SW2 arranged close to the ears of the listener 4 as represented by solid outlines.

The center channel speaker 11C, the front left and right channel speakers 11FL and 11FR, and the rear left and right channel speakers 11RL and 11RR, represented by broken outlines, are not employed. The audio signals to be supplied to these speakers are virtual sound imaged, and then actually supplied to the speakers 11SW1 and 11SW2. The listener 4 feels as if the sounds are emitted by the speakers at the positions represented by the broken outlines.

The center channel audio signal is added to the front left and right channel audio signals. The front left and right channel audio signals with the center channel audio signal synthesized therewith are virtual sound imaged. As represented by broken line in FIG. 18, the listener 4 virtually hears the center channel audio signal as if the corresponding sound is emitted from the position of the center channel speaker 11C.

In accordance with the fourth embodiment, the speakers 11SW1 and 11SW2 (also the auxiliary subwoofers 11SW3 and 11SW4 depending on the set-up) may be mounted on the chair 20 as previously shown in FIG. 5 and FIGS. 6A and 6B.

Figure 19:
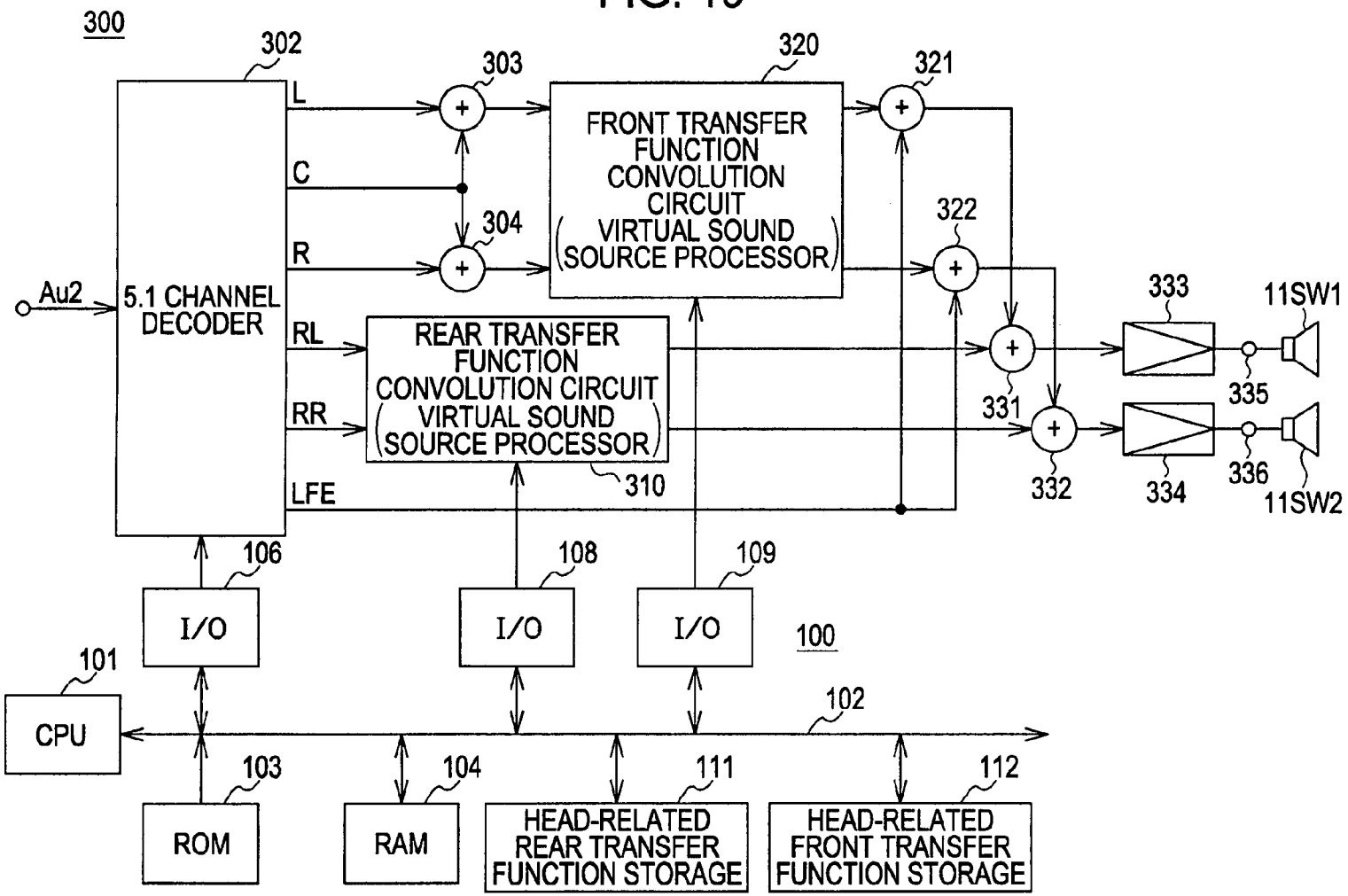
FIG. 19 is a block diagram of an audio signal output device in the audio reproducing system in accordance with the fourth embodiment of the present invention.

FIG. 19 is a block diagram of an audio signal output device 3 in accordance with the fourth embodiment of the present invention. As the audio signal output device 3 of the preceding embodiments, the audio signal output device 3 of the fourth embodiment also includes the audio signal processor 300 and the controller 100 composed of a microcomputer.

The controller 100 of the fourth embodiment is different from the controller 100 of the first embodiment in that the a head-related front transfer function storage 112 is additionally included in addition to the head-related rear transfer function storage 111 and that an input-output port 109 is also additionally included. The rest of the controller 100 remains almost unchanged from the controller 100 of the first embodiment.

The input selection switch 301 of the first embodiment is not included in the audio signal processor 300 of the fourth embodiment. The audio signal processor 300 of the fourth embodiment includes, among other elements, the 5.1 channel decoder 302, the rear transfer function convolution circuit 310 of the first embodiment and the front transfer function convolution circuit 320 of the third embodiment.

Upon receiving the audio signal Au2 from the DVD player 2, the 5.1 channel decoder 302 decodes the audio signal Au2, thereby producing the front left and right channel audio signals L and R, the center channel audio signal C, the rear left and right channel audio signals RL and RR, and the low-frequency audio signal LFE.

As in the third embodiment, the front left channel audio signal L and the center channel audio signal C, from the 5.1 channel decoder 302, are synthesized by the synthesizer 303, and the synthesized output audio signal (L+C) is supplied to the front transfer function convolution circuit 320. The front right channel audio signal R and the center channel audio signal C, from the 5.1 channel decoder 302, are synthesized by the synthesizer 304 and the synthesized output audio signal (R+C) is supplied to the front transfer function convolution circuit 320.

As in the first embodiment, the rear left and right channel audio signals RL and RR from the 5.1 channel decoder 302 are supplied to the rear transfer function convolution circuit 310 functioning as a virtual sound source processor.

The head-related rear transfer function storage 111 stores the head-related rear transfer function as discussed in connection with the first embodiment with reference to FIG. 8. The head-related rear transfer function stored on the head-related rear transfer function storage 111 is read and supplied to the rear transfer function convolution circuit 310 via the input-output interface 108. The rear transfer function convolution circuit 310 convolutes the rear left and right channel signals from the 5.1 channel decoder 302 with the head-related rear transfer function.

The head-related front transfer function storage 112 stores the head-related front transfer function discussed in connection with the third embodiment with reference to FIG. 16. The head-related front transfer function stored on the head-related front transfer function storage 112 is read and supplied to the front transfer function convolution circuit 320 via the input-output port 109. The front transfer function convolution circuit 320 convolutes the front left and right channel signals, each signal with the center channel audio signal C synthesized therewith, from the synthesizers 303 and 304, with the head-related front transfer function.

The virtual sound imaged, front left channel audio signal with the center channel audio signal C synthesized therewith from the front transfer function convolution circuit 320 is synthesized with the low-frequency audio signal LFE from the 5.1 channel decoder 302 by a synthesizer 321. The synthesized signal is then supplied to a synthesizer 331. The synthesizer 331 synthesizes the synthesized signal with the virtual sound imaged, rear left channel audio signal from the rear transfer function convolution circuit 310. The resulting synthesized signal from the synthesizer 331 is supplied to the speaker 11SW1 via an amplifier 333 and an audio output terminal 335.

Similarly, the virtual sound imaged, front right channel audio signal with the center channel audio signal C synthesized therewith from the front transfer function convolution circuit 320 is synthesized with the low-frequency audio signal LFE from the 5.1 channel decoder 302 by a synthesizer 322. The synthesized signal is then supplied to a synthesizer 332. The synthesizer 332 synthesizes the synthesized signal with the virtual sound imaged, rear front channel audio signal from the rear transfer function convolution circuit 310. The resulting synthesized signal from the synthesizer 332 is supplied to the speaker 11SW2 via an amplifier 334 and an audio output terminal 336.

The subwoofers 11SW1 and 11SW2 reproduce the low-frequency audio signal LFE while at the same time the virtual sound imaged, front audio signal (FL*+C) and (FR*+C) and the virtual sound imaged, rear audio signals RL* and RR*.

The audio signal system to be supplied to the auxiliary subwoofers 11SW3 and 11SW4 is not shown in FIG. 19. As previously discussed, only the low-frequency audio signal LFE may be supplied to the auxiliary subwoofers 11SW3 and 11SW4. Furthermore, the virtual sound imaged, audio signals (FL*+C) and (FR*+C) or virtual sound imaged, rear audio signals RL* and RR* may be supplied to the auxiliary subwoofers 11SW3 and 11SW4 in addition to the low-frequency audio signal LFE.

In accordance with the fourth embodiment, the listener 4 can enjoy a high-volume level and presence-rich multi-channel sound with only the speakers 11SW1 and 11SW2 arranged close to the ears of the listener 4 while substantially reducing the leakage of sound to the ambient environment. The audio reproducing system also achieves energy saving.

Other Embodiments

In accordance with the preceding embodiments, the speakers are mounted on the chair so that the speakers come close to the ears of the listener 4 when the listener 4 sits on the chair. The mechanism of arranging the speakers close to the ears of the listener 4 is not limited to the chair.

In accordance with the preceding embodiments, the speaker holder fixed to the chair supports the speaker units of the subwoofers 11SW1 and 11SW2 without being contained in the speaker boxes and without being secured to the baffle board. The speaker holder is not necessarily fixed to the chair.

Figure 20:
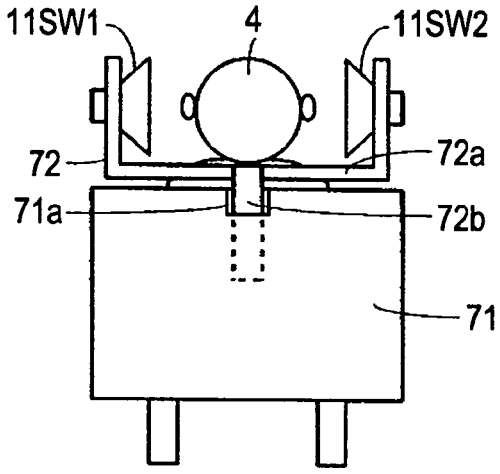
FIG. 20 illustrates a speaker mounting example in the audio reproducing system in accordance with one embodiment of the present invention.
Figure 21:
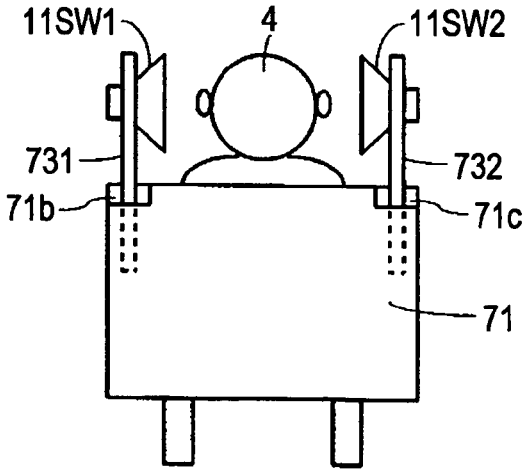
FIG. 21 illustrates a speaker mounting example in the audio reproducing system in accordance with one embodiment of the present invention.

FIGS. 20 and 21 show two speaker holders, made of aluminum pipe as in the preceding embodiments, supporting the speakers 11SW1 and 11SW2. The speaker holder connects the speakers 11SW1 and 11SW2 detachably to the chair.

As shown in FIG. 20, the speakers 11SW1 and 11SW2 are respectively fixed to on both sides of a T-shaped arm portion 72*a* of a speaker holder 72. The speakers 11SW1 and 11SW2 are mounted on the speaker holder 72 with a predetermined distance maintained therebetween in a manner such that diaphragm faces thereof face each other.

In this case as well, the distance between the diaphragm face of the first speaker 11SW1 and the diaphragm face of the second speaker 11SW2 is set so that the ears of the listener 4 are spaced from the corresponding speakers 11SW1 and 11SW2 by the distance dsw discussed with reference to FIG. 2 when the head of the listener 4 comes between the speakers 11SW1 and 11SW2.

A center arm 72*b* of the speaker holder 72 is inserted into a speaker holder socket 71*a* arranged in a chair 71. The center arm 72*b* thus fixes the speaker holder 72 to the chair 71.

The speaker holder socket 71*a* of the chair 71 is arranged in the center portion of the back of the chair 71 so that the center arm 72*b* is approximately aligned with the center line of the listener 4 when the listener 4 sits on the chair 71.

When the listener 4 enjoys music with the speakers 11SW1 and 11SW2 as shown in FIG. 20, the listener 4 inserts the center arm 72*b* of the speaker holder 72 into the speaker holder socket 71*a* so that the speakers 11SW1 and 11SW2 are mounted on the chair 71.

When the listener 4 sits on the chair 71 as shown in FIG. 20, the speakers 11SW1 and 11SW2 are arranged close to the ears of the listener 4 with the predetermined distance dsw maintained therebetween. A low-frequency sound, even at a low sound level, is reproduced at a sufficient volume with less noise leaked to the ambient environment.

As shown in FIG. 21, the speakers 11SW1 and 11SW2 are fixed to a speaker holder 731 and a speaker holder 732, respectively. A speaker holder socket 71*b* is arranged on one side of the back of the chair 71 that comes close to one shoulder side of the listener 4 when the listener 4 sits on the chair 71. The speaker holder socket 71*b* receives the speaker holder 731. A speaker holder socket 71*c* is arranged on the other side of the back of the chair 71 that comes close to the other shoulder side of the listener 4 when the listener 4 sits on the chair 71. The speaker holder socket 71*c* receives the speaker holder 732.

When the listener 4 listens to music with the speakers 11SW1 and 11SW2 as shown in FIG. 21, the listener 4 inserts the speaker holder 731 into the speaker holder socket 71*b* of the chair 71 and inserts the speaker holder 732 into the speaker holder socket 71*c* of the chair 71. The speakers 11SW1 and 11SW2 are thus mounted on the chair 71.

The speaker holders 731 and 732 are mounted on the chair 71 as shown in FIG. 21. The distance between the diaphragm surface of the speaker 11SW1 and the diaphragm surface of the speaker 11SW2 is set up so that the distance between the ears of the listener 4 and the corresponding speakers 11SW1 and 11SW2 is the distance dsw as discussed with reference to FIG. 2 when the head of the listener 4 comes between the speakers 11SW1 and 11SW2.

When the listener 4 sits on the chair 71 as shown in FIG. 21, the speakers 11SW1 and 11SW2 are arranged close to the ears of the listener 4 with the predetermined distance dsw maintained therebetween. A low-frequency sound, even at a low sound level, is reproduced at a sufficient volume with less noise leaked to the ambient environment.

With reference to FIGS. 20 and 21, the speaker holder 72 or the speaker holders 731 and 732 can be removed from the chair 71 during standard use, and the speakers 11SW1 and 11SW2 are not in the way of the user of the chair 71 and easy to operate.

The application of the speakers 11SW1 and 11SW2 is not limited to the chair described above.

Figure 22:
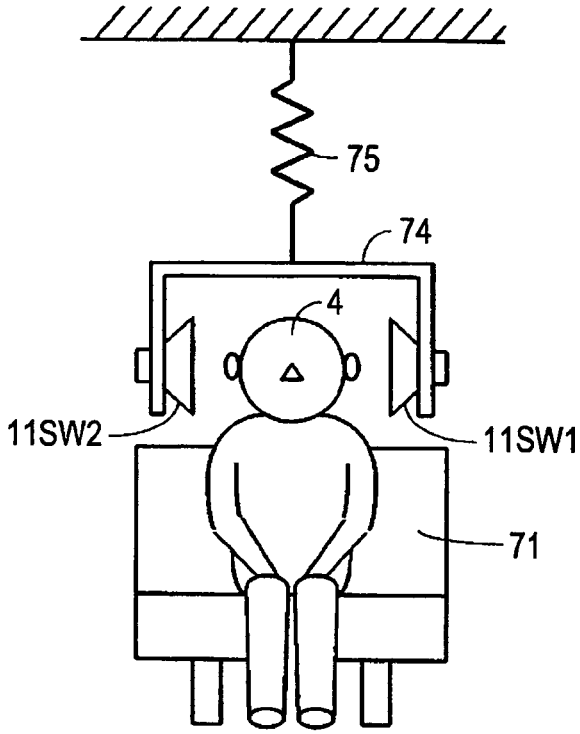
FIG. 22 illustrates a speaker mounting example in the audio reproducing system in accordance with one embodiment of the present invention.

FIG. 22 illustrates the speakers 11SW1 and 11SW2 supported by a speaker holder 74. As shown, the speaker holder 74, supporting the speakers 11SW1 and 11SW2 facing with each other with the same distance maintained as the one shown in FIGS. 20 and 21, is suspended by a suspension member 75 from a ceiling.

As shown in FIG. 22, the length of the suspension member 75 from the ceiling is adjustable (although such a mechanism is not shown). By adjusting the length of the suspension member 75, the speakers 11SW1 and 11SW2 are arranged close to the ears of the listener 4 with the predetermined distance dsw permitted therebetween when the listener 4 sits on the chair 71.

Figure 23:
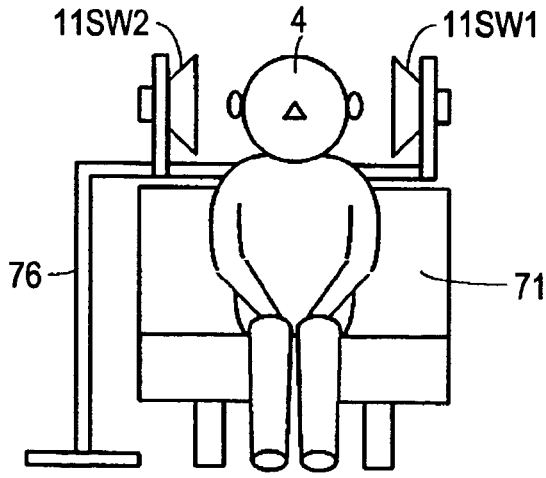
FIG. 23 illustrates a speaker mounting example in the audio reproducing system in accordance with one embodiment of the present invention.

FIG. 23 illustrates the speakers 11SW1 and 11SW2 supported by a stand-alone type speaker holder 76. The speaker holder 76 supports the speakers 11SW1 and 11SW2 facing with each other with the predetermined distance maintained therebetween as shown in FIGS. 20 and 21.

Figure 24:
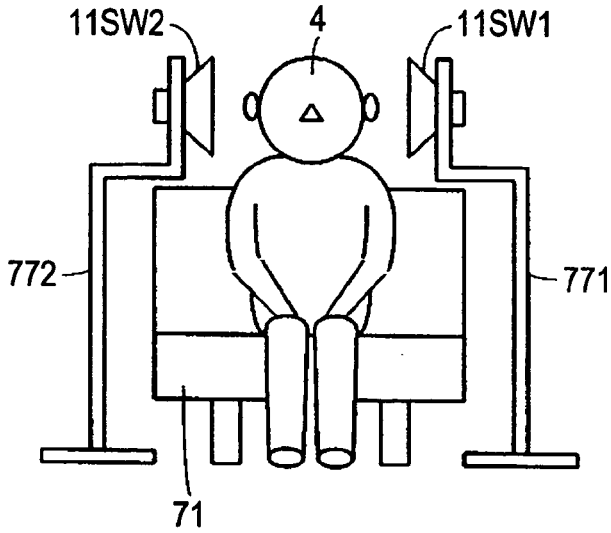
FIG. 24 illustrates a speaker mounting example in the audio reproducing system in accordance with one embodiment of the present invention.

FIG. 24 illustrates the speakers 11SW1 and 11SW2 supported by stand-alone type speaker holders 771 and 772, respectively, in a manner similar to the mechanism of FIG. 23. As shown in FIG. 24, the speakers 11SW1 and 11SW2 are respectively supported by stand-alone type speaker holders 771 and 772.

With reference to FIG. 23, if the speaker holder 76 is placed correctly to the listener 4, the speakers 11SW1 and 11SW2 are also placed correctly as shown in FIGS. 20 and 21.

With reference to FIG. 24, the speaker holders 771 and 772 are fully separate from each other. The listener 4 may place each of the stand-alone type speaker holders 771 and 772 at any convenient location.

Figure 25:
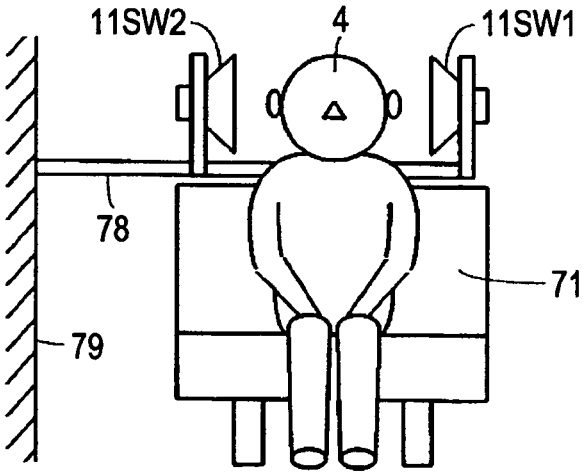
FIG. 25 illustrates a speaker mounting example in the audio reproducing system in accordance with one embodiment of the present invention.

FIG. 25 illustrates the speakers 11SW1 and 11SW2 supported by a speaker holder 78. The speaker holder 78 secured to a wall 79 supports the speakers 11SW1 and 11SW2 facing with each other with the predetermined distance maintained therebetween as shown in FIGS. 20 and 21.

As shown in FIG. 25, the distance between the speakers 11SW1 and 11SW2 is fixed by the speaker holder 78 in a similar manner as shown in FIG. 23, and the listener 4 simply places his head in the center between the speakers 11SW1 and 11SW2.

Figure 26A:
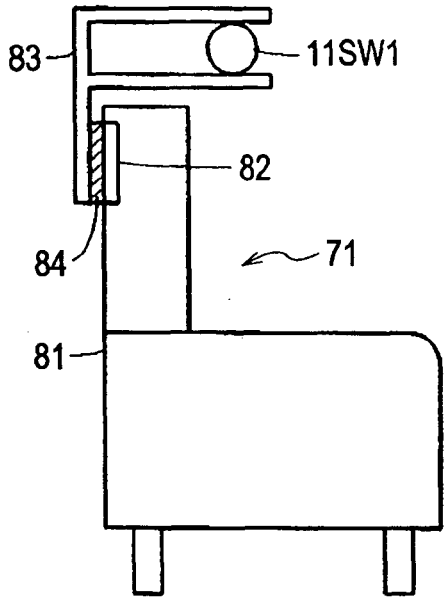
FIG. 26 illustrates a speaker mounting example in the audio reproducing system in accordance with one embodiment of the present invention.
Figure 26B:
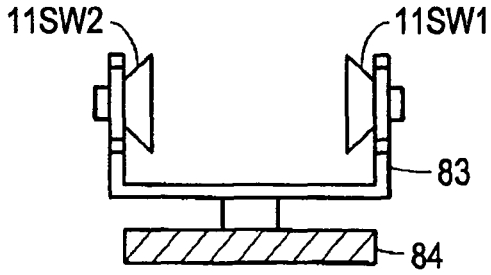

FIGS. 26A and 26B illustrate a speaker holder 83 detachably mounted onto the chair 71. As shown in FIG. 26A, a steel plate is embedded in a back side of a back 81 of the chair 71.

The speaker holder 83 supports the speakers 11SW1 and 11SW2 facing each other with the distance maintained therebetween as shown in FIGS. 20 and 21. The speaker holder 83 has a magnet unit 84 bolted thereto. The speaker holder 83 is fixed to the back 81 of the chair 71 with the magnet unit 84 magnetically attracted to the steel plate 82 embedded in the back 81 of the chair 71.

As shown in FIGS. 26A and 26B, the listener 4 simply sits on the chair 71 with his head between the speakers 11SW1 and 11SW2.

The placement examples of the subwoofers 11SW1 and 11SW2 with respect to the listener 4 have been discussed. The present invention is applicable when a plurality of persons listen to music at the same time. FIGS. 27-30 illustrate such placement examples of the speakers 11SW1 and 11SW2 in which a plurality of listeners enjoy music.

FIG. 27 and FIGS. 28A-28C illustrate an audio reproducing system in which the speakers are arranged in the vicinity of ears of two listeners 4A and 4B. The placement example here is an application of the example of FIGS. 26A and 26B.

Figure 27:
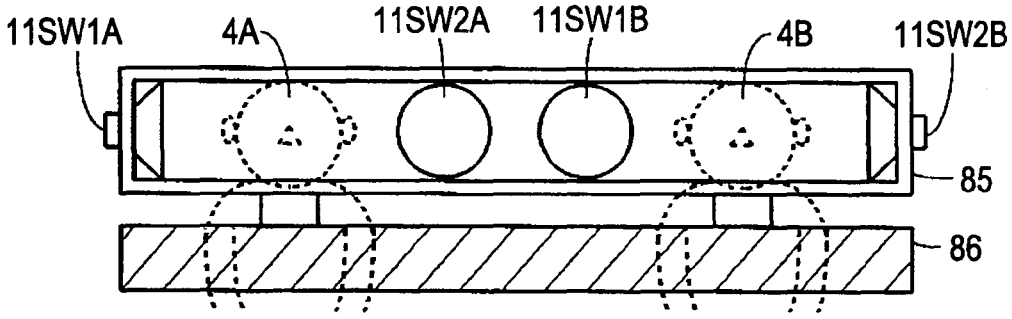
FIG. 27 illustrates a speaker mounting example in the audio reproducing system in accordance with one embodiment of the present invention.

With reference to FIG. 27, a speaker holder 85 made of aluminum pipe supports the speakers 11SW1A and 11SW2A for the listener 4A and speakers 11SW1B and 11SW2B for the listener 4B.

Figure 28A:
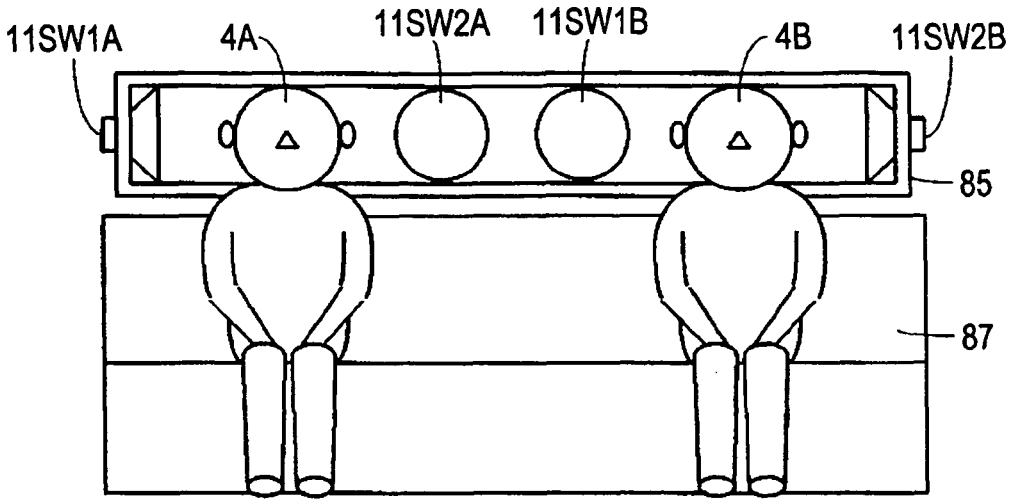
FIG. 28 illustrates a speaker mounting example in the audio reproducing system in accordance with one embodiment of the present invention.

A steel plate (not shown) is embedded in the back of a sofa 87 as shown in FIG. 28A in the same manner as shown in FIG. 26A. A magnet unit 86 (see FIG. 27) is bolted to the speaker holder 85. The speaker holder 85 is thus fixed to the sofa 87 with the magnet unit 86 magnetically attracted to the steel plate embedded in the back of the sofa 87.

Figure 28B:
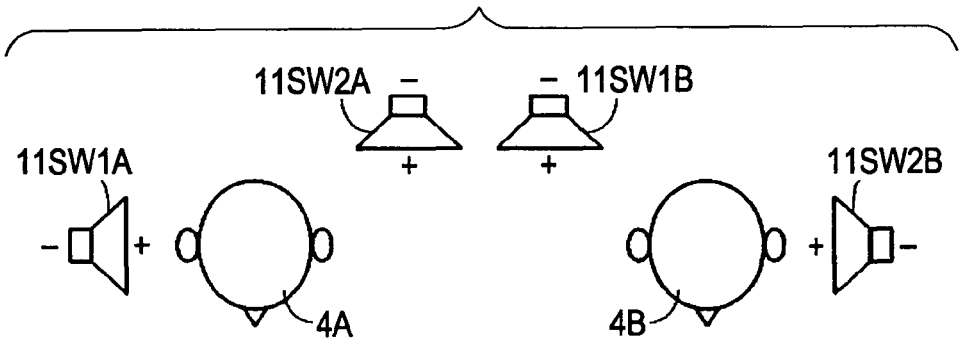

The positional relationship of the speakers 11SW1A and 11SW2A with the listener 4A and the positional relationship of the speakers 11SW1B and 11SW2B remain unchanged from those previously discussed. The speaker 11SW2A and the speaker 11SW2B do not face the speaker 11SW1A and the speaker 11SW1B, respectively, as shown in FIG. 28B, and emit sounds from behind the listener 4A and the listener 4B. The speaker 11SW2A and the speaker 11SW2B emit sounds from the diaphragms thereof in a direction perpendicular to a direction in which the speaker 11SW1A and the speaker 11SW1B emits sounds from the diaphragms thereof.

A sound from the diaphragm of each of the speakers 11SW1A and 11SW2A travels in a direction perpendicular to a direction in which a sound from the diaphragm of each of the speakers 11SW1B and 11SW2B travels.

If an imaginary line extends from the center of each diaphragm of the speakers 11SW2A and 11SW2B in a direction perpendicular to the diaphragm, the imaginary line passes by the ear of each listener with the distance dsw.

When the listeners 4A and 4B sit on the sofa 87 as shown in FIG. 28A, the speakers 11SW1A and 11SW2A provides the reproduced sound thereof to the listener 4A and the speakers 11SW1B and 11SW2B provides the reproduced sound thereof to the listener 4B.

Figure 28C:
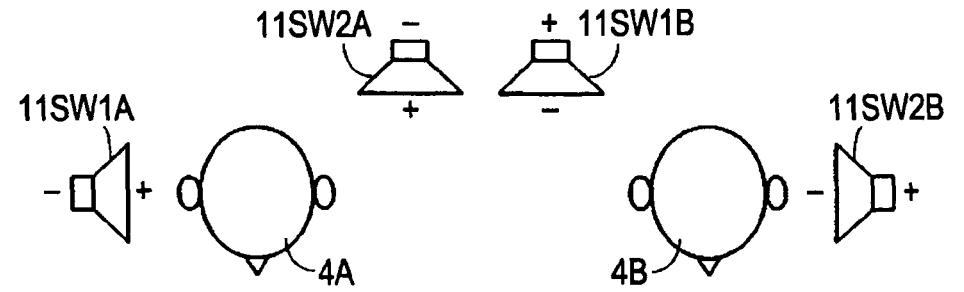

As shown in FIG. 28B, the audio signals are supplied to the speakers 11SW1A and 11SW2A so that the speakers 11SW1A and 11SW2A emit sound wave in phase from the diaphragms thereof (the front of the speaker units) to the ears of the listener 4A. Similarly, the audio signals are supplied to the speakers 11SW1B and 11SW2B so that the speakers 11SW1B and 11SW2B emit sound wave in phase from the diaphragms thereof (the front of the speaker units) to the ears of the listener 4B. In FIGS. 28B and 28C, symbols "+" and "−" represent phases of a sound wave, and "+" and "−" are opposite in phase to each other.

As shown in FIG. 28B, the two speakers for the listener 4A and the two speakers for the listener 4B provide the sound waves in phase. If the listener 4A and the listener 4B are relatively spaced from each other, the two speakers for the listener 4A and the two speakers for the listener 4B provide the sound waves in opposite phase as shown in FIG. 28C.

Figure 29:
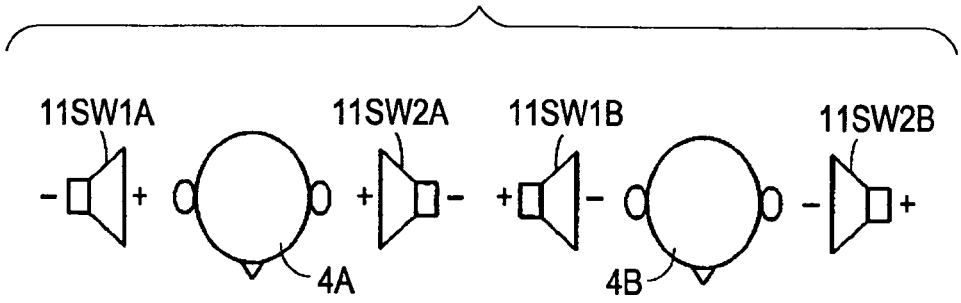
FIG. 29 illustrates a speaker mounting example in the audio reproducing system in accordance with one embodiment of the present invention.

As shown in FIG. 29, the speakers 11SW1A and 11SW2A for the listener 4A are arranged with the diaphragms thereof facing each other and the head of the listener 4A comes between the speakers 11SW1A and 11SW2A. Similarly, the speakers 11SW1B and 11SW2B for the listener 4B are arranged with the diaphragms thereof facing each other and the head of the listener 4B comes between the speakers 11SW1B and 11SW2B.

In the placement example of FIG. 29, the speaker 11SW2A for the listener 4A and the speaker 11SW2B are preferably arranged so that the sound waves emitted from the backs of the diaphragms thereof mutually cancel each other. The audio signals are supplied to the speakers so that the sound waves from the speakers 11SW1A and 11SW2A for the listener 4A are opposite in phase from the sound waves from the speakers 11SW1B and 11SW2B for the listener 4B.

The audio reproducing systems providing music to a plurality of listeners shown in FIGS. 28A-28C and FIG. 29 employ the magnet units to fix the speaker holders to the sofa. A variety of other mechanisms is available, including the suspension mechanism from the ceiling shown in FIG. 22, the stand-alone speaker holders of FIGS. 23 and 24, and a mechanism in which a speaker holder is fixed to a wall.

With reference to FIGS. 20-29, the speakers to be mounted are subwoofers. Each speaker holder may support rear speaker or the like as necessary.

Modifications of Other Embodiments

Figure 30:
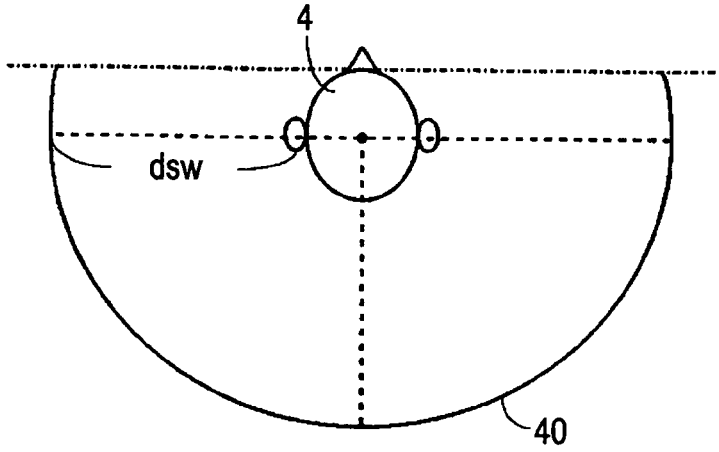
FIG. 30 illustrates a speaker mounting example in the audio reproducing system in accordance with one embodiment of the present invention.
Figure 31:
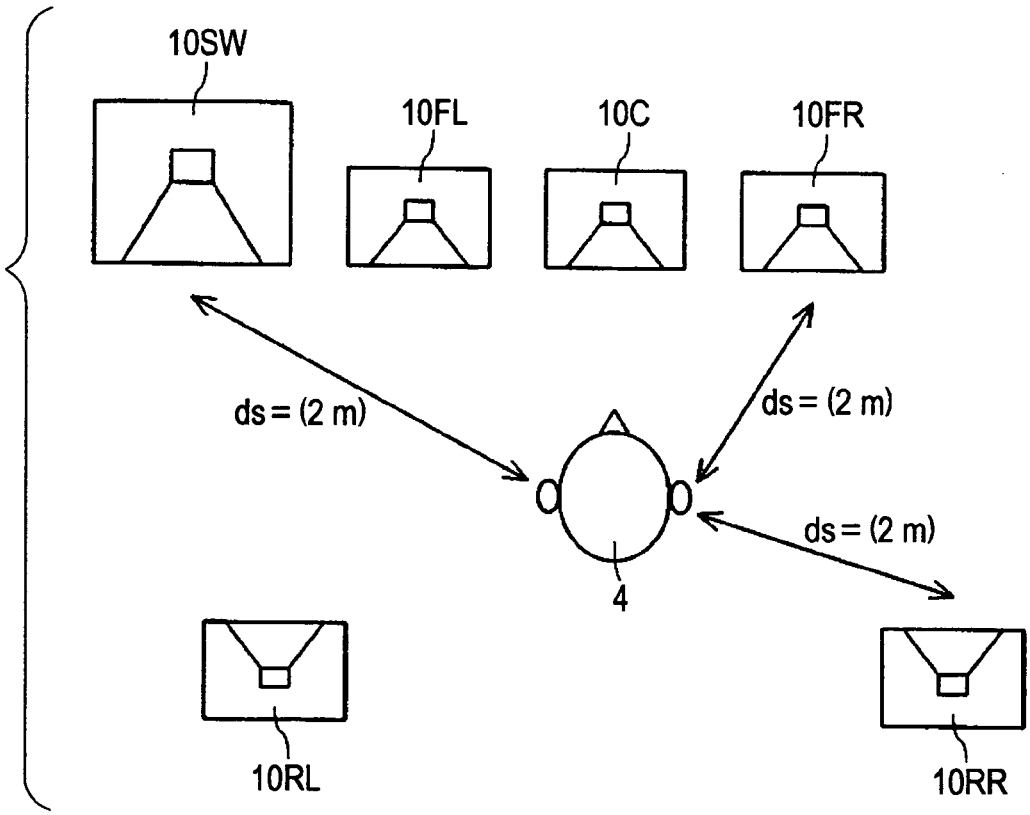
FIG. 31 illustrates a typical speaker mounting example in a known audio reproducing system.

Since the speakers 11SW1 and 11SW2 arranged close to the ears of the listener 4 face the ears of the listener 4 in accordance with the preceding embodiments, the low-frequency sound reaches the listener 4 at a high efficiency. The placement position of the speaker is not limited to this location. For example, as shown in FIG. 30, the speaker placement position may be at any point in a sphere (having a distance of dsw+the radius of the head of the listener 4) centered on the center of the head of the listener 4. However, the speaker is placed preferably within space behind the plane of the face of the listener 4. The placement of the speaker within space ahead of the plane of the of the listener 4 is not preferable as shown in FIG. 30.

In the preceding embodiments, the speakers 11SW1 and 11SW2 arranged close to the ears of the listener 4 are always subwoofers. The speakers 11SW1 and 11SW2 are not necessarily subwoofers, and the subwoofers may be separately arranged.

The mechanism of installing the speaker units of the speakers 11SW1 and 11SW2 to allow sounds to be emitted from the front and back of each diaphragm in a sound additive manner is not limited to the pipe mounting structure discussed above. For example, a speaker unit for the low-frequency sound may be fixed onto a plate having a number of large-size holes opened therein, and sounds emitted from the front and back of each diaphragm through the holes may be added together.

The audio reproducing system reproduces the 5.1 channel audio signal. The present invention is applicable to an audio reproducing system that reproduces not only the 5.1 channel audio signal but also a plurality of other channel audio signals.

It should be understood by those skilled in the art that various modifications, combinations, sub-combinations and alterations may occur depending on design requirements and other factors insofar as they are within the scope of the appended claims or the equivalents thereof.

What is claimed is:

1. An audio reproducing system comprising:

a pair of speaker units;

mounting means for mounting the pair of speaker units, without being attached to a baffle board, to the vicinity of a listener's ears in a manner such that sounds emitted from the front and back of a diaphragm of each speaker unit are mixed;

a transfer function storage for storing at least one transfer function; and audio signal output means for virtual sound imaging using the at least one transfer function and at least a portion of a multi-channel surround sound signal and outputting the virtual sound imaged signal to the pair of speaker units in a manner such that the listener listens to a sound reproduced by the pair of speaker units feeling as if the sound is emitted from a different speaker device, wherein the multi-channel surround sound signal comprises a low-frequency audio signal, and wherein the pair of speaker units are supplied with the low-frequency audio signal.

2. The audio reproducing system according to claim 1, wherein the multi-channel surround sound signal comprises a rear-channel audio signal, and wherein the audio signal output means virtual sound images the rear-channel audio signal and outputs the virtual sound imaged signal to the pair of speaker units in a manner such that the listener listens to a sound reproduced by the pair of speaker units feeling as if the sound is emitted from a speaker device that is placed behind the listener.

3. The audio reproducing system according to claim 1, wherein the multi-channel surround sound signal comprises a front-channel audio signal, and wherein the audio signal output means virtual sound images the front-channel audio signal and outputs the virtual sound imaged signal to the pair of speaker units in a manner such that the listener listens to a sound reproduced by the pair of speaker units feeling as if the sound is emitted from a speaker device that is placed in front of the listener.

4. The audio reproducing system according to claim 1, wherein the multi-channel surround sound signal comprises a front-channel audio signal and a rear-channel audio signal, and wherein the audio signal output means virtual sound images the front-channel audio signal and outputs the virtual sound imaged signal to the pair of speaker units in a manner such that the listener listens to a sound reproduced by the pair of speaker units feeling as if the sound is emitted from a speaker device that is placed in front of the listener, and virtual sound images the rear-channel audio signal and outputs the virtual sound imaged signal to the pair of speaker units in a manner such that the listener listens to a sound reproduced by the pair of speaker units feeling as if the sound is emitted from a speaker device that is placed behind the listener.

5. The audio reproducing system according to claim 1, wherein the mounting means mount the pair of speaker units to a chair on which the listener sits.

6. The audio reproducing system according to claim 1, wherein the pair of speaker units are mounted facing the right and left ears of the listener, respectively.

7. The audio reproducing system according to claim 6, wherein the mounting means mounts the pair of speaker units within space behind a plane of the face of the listener.

8. The audio reproducing system according to claim 3, wherein the mounting means further mounts a speaker for a rear-channel audio signal of the multi-channel surround sound.

9. A method of reproducing audio sound, comprising steps of:

mounting a pair of speaker units, without being attached to a baffle board, to the vicinity of a listener's cars in a manner such that sounds emitted from the front and back of a diaphragm of each speaker unit are mixed; and virtual sound imaging using at least one transfer function at least a portion of a multi-channel surround sound signal and outputting the virtual sound imaged signal to the pair of speaker units in a manner such that the listener listens to a sound reproduced by the pair of speaker units feeling as if the sound is emitted from a different speaker device, wherein the multi-channel surround sound signal comprises a low-frequency audio signal, and wherein the pair of speaker units are supplied with the low-frequency audio signal.

10. The method according to claim 9, further comprising virtual sound imaging a rear-channel audio signal of the multi-channel surround sound signal and outputting the virtual sound imaged signal to the pair of speaker units in a manner such that the listener listens to a sound reproduced by the pair of speaker units feeling as if the sound is emitted from a speaker device that is placed behind the listener.

11. The method according to claim 9, further comprising virtual sound imaging a front-channel audio signal of the multi-channel surround sound signal and outputting the virtual sound imaged signal to the pair of speaker units in a manner such that the listener listens to a sound reproduced by the pair of speaker units feeling as if the sound is emitted from a speaker device that is placed in front of the listener.

12. The method according to claim 9, further comprising virtual sound imaging a front-channel audio signal of the multi-channel surround sound signal and outputting the virtual sound imaged signal to the pair of speaker units in a manner such that the listener listens to a sound reproduced by the pair of speaker units feeling as if the sound is emitted from a speaker device that is placed in front of the listener, and virtual sound imaging a rear-channel audio signal of the multi-channel surround sound signal and outputting the virtual sound imaged signal to the pair of speaker units in a manner such that the listener listens to a sound reproduced by the pair of speaker units feeling as if the sound is emitted from a speaker device that is placed behind the listener.

13. An audio reproducing system comprising:

a pair of speaker units;

a mounting unit mounting the pair of speaker units, without being attached to a baffle board, to the vicinity of a listener's ears in a manner such that sounds emitted from the front and back of a diaphragm of each speaker unit are mixed;

a transfer function storage for storing at least one transfer function; and an audio signal output unit virtual sound imaging using the at least one transfer function and at least a portion of a multi-channel surround sound signal and outputting the virtual sound imaged signal to the pair of speaker units in a manner such that the listener listens to a sound reproduced by the pair of speaker units feeling as if the sound is emitted from a different speaker device, wherein the multi-channel surround sound signal comprises a low-frequency audio signal, and wherein the pair of speaker units are supplied with the low-frequency audio signal.

* * * * *